US006050197A

United States Patent [19]

Wicks

[11] Patent Number: 6,050,197

[45] Date of Patent: Apr. 18, 2000

[54] INTERMODAL VEHICLE FOR FORMING A TRAIN OF HIGHWAY TRAILERS

[75] Inventor: Harry O. Wicks, El Paso, Tex.

[73] Assignee: RailRunner Systems, Inc., Barnesville, Ga.

[21] Appl. No.: 09/018,581

[22] Filed: Feb. 4, 1998

[51] Int. Cl.[7] ..... B61F 3/00

[52] U.S. Cl. ..... 105/4.2; 105/4.1

[58] Field of Search ..... 105/3, 4.1, 4.2, 105/4.4, 159, 199.3

[56] References Cited

U.S. PATENT DOCUMENTS

| | | | |
|---|---|---|---|
| 1,456,839 | 5/1923 | Westlake | 105/4.1 |
| 2,111,676 | 3/1938 | Ritchie | 105/4.2 |
| 4,202,276 | 5/1980 | Browne et al. . | |
| 4,547,107 | 10/1985 | Krause . | |
| 4,665,834 | 5/1987 | Van Iperen . | |
| 4,753,174 | 6/1988 | Berg et al. . | |
| 4,817,536 | 4/1989 | Cripe et al. . | |
| 4,955,144 | 9/1990 | Lienard et al. . | |
| 5,009,169 | 4/1991 | Viens . | |
| 5,020,445 | 6/1991 | Adams | 105/4.1 |
| 5,040,466 | 8/1991 | Wicks et al. . | |
| 5,107,772 | 4/1992 | Viens . | |
| 5,152,228 | 10/1992 | Donkin . | |
| 5,199,359 | 4/1993 | Bedard . | |
| 5,216,956 | 6/1993 | Adams, Jr. . | |
| 5,291,835 | 3/1994 | Wicks . | |
| 5,431,110 | 7/1995 | Adams | 105/4.1 |
| 5,890,433 | 4/1999 | Wicks | 105/4.2 |

FOREIGN PATENT DOCUMENTS

| | | |
|---|---|---|
| 20 51 272 | 10/1979 | Germany . |
| 195 15 110 | 10/1996 | Germany . |
| 1-47672 | 2/1989 | Japan . |
| 2 150 900 | 7/1985 | United Kingdom . |

*Primary Examiner*—Mark T. Le
*Attorney, Agent, or Firm*—John C. Thompson

[57] ABSTRACT

An improved intermodal vehicle (10) for forming a train of highway trailers. The intermodal vehicle has an upper frame (42) to which highway trailers (12, 14) may be connected, each of the highway trailers having leading a trailing coupler socket assemblies (22, 24). In the improved design a continuous drawbar (150, 176) is provided. In addition, the upper frame (42) is mounted on a pair of steerable lower frames (30, 32) by springs (52, 54), preferably air springs, their being a pair of springs for each rail wheel (26, 28) of the intermodal vehicle, one spring being positioned before each wheel and one being positioned after each wheel.

16 Claims, 24 Drawing Sheets

INTERMODAL VEHICLE FOR FORMING A TRAIN OF HIGHWAY TRAILERS

TECHNICAL FIELD

This invention deals with improvements in intermodal rail vehicles of the type shown in applicant's prior U.S. Pat. No. 5,291,835 and applicant's prior PCT application PCT/US94/02212 published under international publication No. WO 94/21503.

BACKGROUND OF THE INVENTION

The above-identified prior art discloses novel intermodal vehicles for use in forming a train of highway trailers including leading and trailing trailers which are interconnected to each other and supported by the intermodal vehicles. The design of the intermodal vehicle of this invention, as well as the prior art referred to above, is intended for use with highway trailers of all configurations, including trailers especially designed to haul so-called "ISO" shipping containers. Each of the highway trailers includes leading and trailing coupler socket assemblies at each end, each of the socket assemblies being apertured for receiving a coupling pin. The intermodal vehicle is characterized by two rail wheel assemblies, lower frame means in which the rail wheel assemblies are supported, and upper lifting frame means supported on the lower frame means by spring means. The spring means are air springs which are so arranged that when air is removed from the air springs, the upper lifting frame means will descend toward the lower frame means, and when air is introduced into the air springs, the upper lifting frame means will rise, at the same time raising any highway trailers which may be resting upon the load carrying surfaces. The upper lifting frame means includes leading and trailing upwardly presented load carrying structures, each of the load carrying structures having an upper trailer support surface for engaging the bottom of the trailers. In addition, each of the load carrying structures also carries a coupler tongue which is adapted to be received in the coupler socket assemblies, each tongue being provided with an aperture. A vertically oriented coupling pin is carried by each of the load carrying structures, which coupling pin is vertically moveable from a position below the trailer support surface to a position where it passes through the apertured socket assemblies for securing a tongue within the apertured socket assembly. WO 94/21503 discloses that the upper frame means may be in two sections, each independently moveable, whereas the above-identified U.S. patent discloses only a single upper frame. Whether or not a split upper frame is used, it is still essential that each tongue be supported for limited pivotal, rolling and pitching movement. It is also a feature of the above-referenced designs that the lower frame means are steerable with respect to the upper frame means. In the above-referenced designs, the load carrying structures are shiftable transversely, that is to say, from side to side perpendicular to the longitudinal centerline of the intermodal vehicle to facilitate the alignment of the trailer as it is connected to the intermodal vehicle. Additional features are disclosed in the foregoing patent and published application.

OBJECTS AND SUMMARY OF THE INVENTION

In the foregoing design, because the tongues must be supported for limited pivotal, rolling and pitching movement, pulling forces are not transmitted directly from one tongue to the other, but instead travel through a generally U-shaped force path. This requires that the load carrying structures be capable of transmitting high centerline forces. Therefore, in order to overcome this structural requirement, it is desirable to provide a continuous draw link arrangement between the tongues.

In the design shown in WO 94/21503, four air springs are employed for raising the upper frame means, each of these air springs being mounted above a rail wheel bearing support. In the present design, eight lifting air spring assemblies are provided, two assemblies being associated with each rail wheel bearing support, one before and one after each support. By employing eight air spring assemblies, increased stability is achieved, and increased lifting capacity is also achieved.

In the prior art designs referred to above, each of the air springs was provided with an internal guide surmounted by a shear spring. This form of design is difficult to assemble and maintain, and therefore it is proposed to use new air spring assemblies which overcome the inherent disadvantages of the prior art air springs. Each of the new air spring assemblies includes a pair of external struts. In the new design, each of the air spring assemblies consists of a single two-convolution air spring and a single one-convolution air spring which is mounted on top of the two-convolution air spring. A mounting plate is disposed above the two-convolution spring and below the one-convolution spring, the mounting plate being guided by the pair of external struts. By using this design, it is not necessary to use the internal guides of the prior art. In addition, the unguided single convolution spring will permit limited movement of the upper frame means in a horizontal plane with respect to the lower frame means, which movement is constrained by steering dampers.

In WO 94/21503, steering dampers are provided (at 96 in FIG. 3 of WO 94/21503) to restrain horizontal movement of the upper frame means relative to the lower frame means. In this invention, a new form of steering damper is provided. Each of the steering dampers in this design is connected with the top of an associated single convolution air spring, each damper being mounted for vertical movement so that it can move vertically with the top of the associated single convolution air spring.

In applicant's prior designs referred to above, no primary latch is provided to initially hold the trailer in place while the coupler pin is being raised. It is an object of the present invention of provide a latch which "clicks" in place to supply an audible signal that the trailer is positioned correctly.

In the present design each of the coupler pins is raised by an air cylinder. A latch is provided under each coupler pin when raised to prevent the coupler pin from accidentally lowering. The latch is mechanically released by an activating rod. When the activating rod is moved to that position where the latch is released, it will also engage an enabling valve which will permit air to be supplied to the coupler pin cylinder for withdrawing the coupler pin, that is to say for moving the coupler pin down to a disengaged position, and which valve will also cause the primary latch to be released.

In the prior art designs referred to above, the trailer supports were permitted to move from side to side when a trailer was being moved onto the upper trailer support surface of the load carrying structure so that the coupler pin would pass through the aperture in the coupler socket assembly on the trailer. However, there was no positive way for controlling the lateral movement of the load carrying structure. In the present design, each of the load carrying structures is transversely actuated by air actuator units, and these structures are locked in their centered position when the upper frame means is raised by the air spring assemblies by a gravity-operated center lock.

It is also a feature of the present design to provide loading ramps on the intermodal vehicle which will be contacted by the underside of the coupler socket assembly on the trailer during train make-up.

It is also a feature of the new design to provide outboard supports which are manually adjustable for height by means of an internal gear box with a jack screw so that they can be raised or lowered to contact the under side of the trailer at the front or the rear.

The foregoing design features will be better understood after a consideration of the following detailed description taken in conjunction with the accompanying drawings in which the best mode of practicing this invention is illustrated.

DETAILED DESCRIPTION

Figure 1:
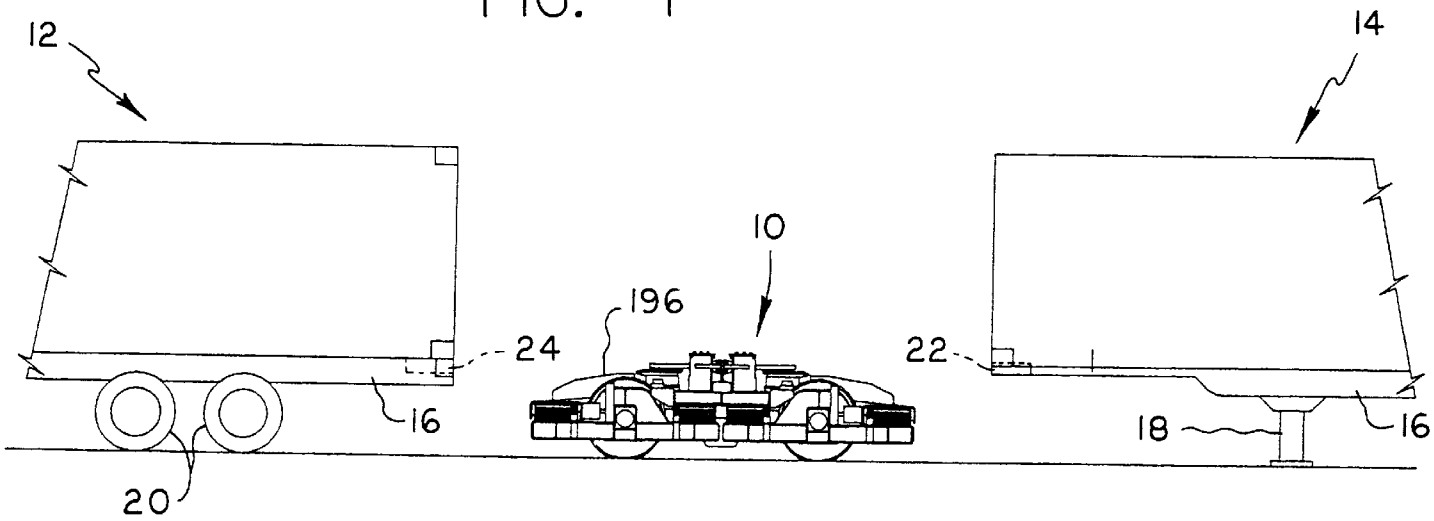
FIGS. 1 and 2 illustrate how a train can be made up using leading and trailing highway trailers and the intermodal rail vehicle of this invention, FIG. 1 showing the trailers and intermodal vehicle before makeup, with the intermodal vehicle being shown in the down position, and FIG. 2 showing the intermodal vehicle connected to the trailers with the intermodal vehicle in its raised position.
Figure 2:
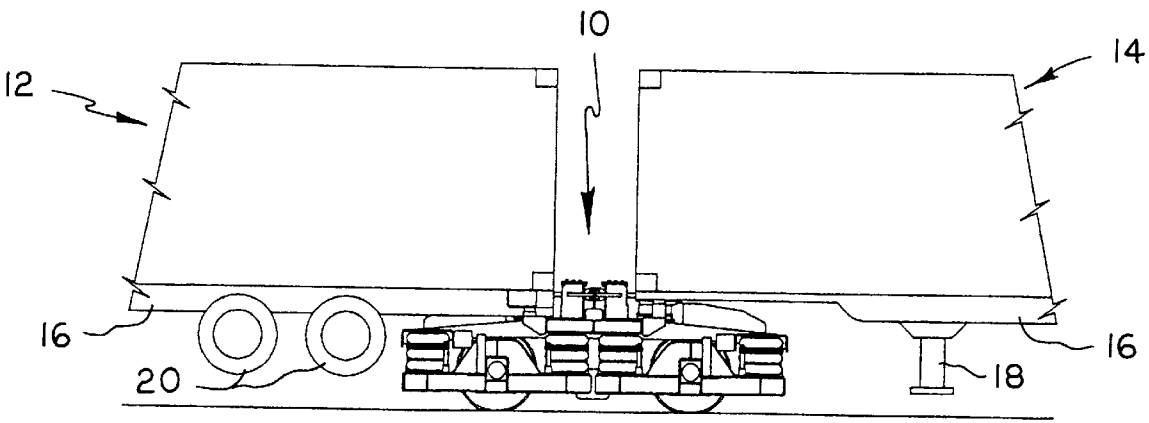

With reference initially to FIGS. 1 and 2, the novel intermodal rail vehicle of this invention is indicated generally at 10. It is designed to be used with other intermodal rail vehicles of the same design to form a train of highway trailers. In FIGS. 1 and 2, two highway trailers are illustrated, one being a leading highway trailer which is indicated generally at 12, and the other being a trailing highway trailer which is indicated generally at 14. The highway trailers 12 and 14 form no part of the present invention and are of the type shown in WO 94/21503 in FIGS. 10–13 and 16. However, it should be noted that each of the highway trailers is provided with a main frame 16, a forward landing gear 18, highway wheel assemblies including wheels 20. In addition, each highway trailer is provided with leading and trailing substantially identical coupling socket assemblies 22 and 24, respectively. Each socket assembly may receive a coupler tongue. In addition, each socket assembly is further provided with apertures (not shown) to facilitate securing the coupler tongue within the socket assembly via a coupler pin carried by the intermodal rail vehicle. As the details of the highway trailers and socket assemblies do not form a part of this invention, and as they are illustrated in WO 94/21503, they will not be described further.

Figure 3:
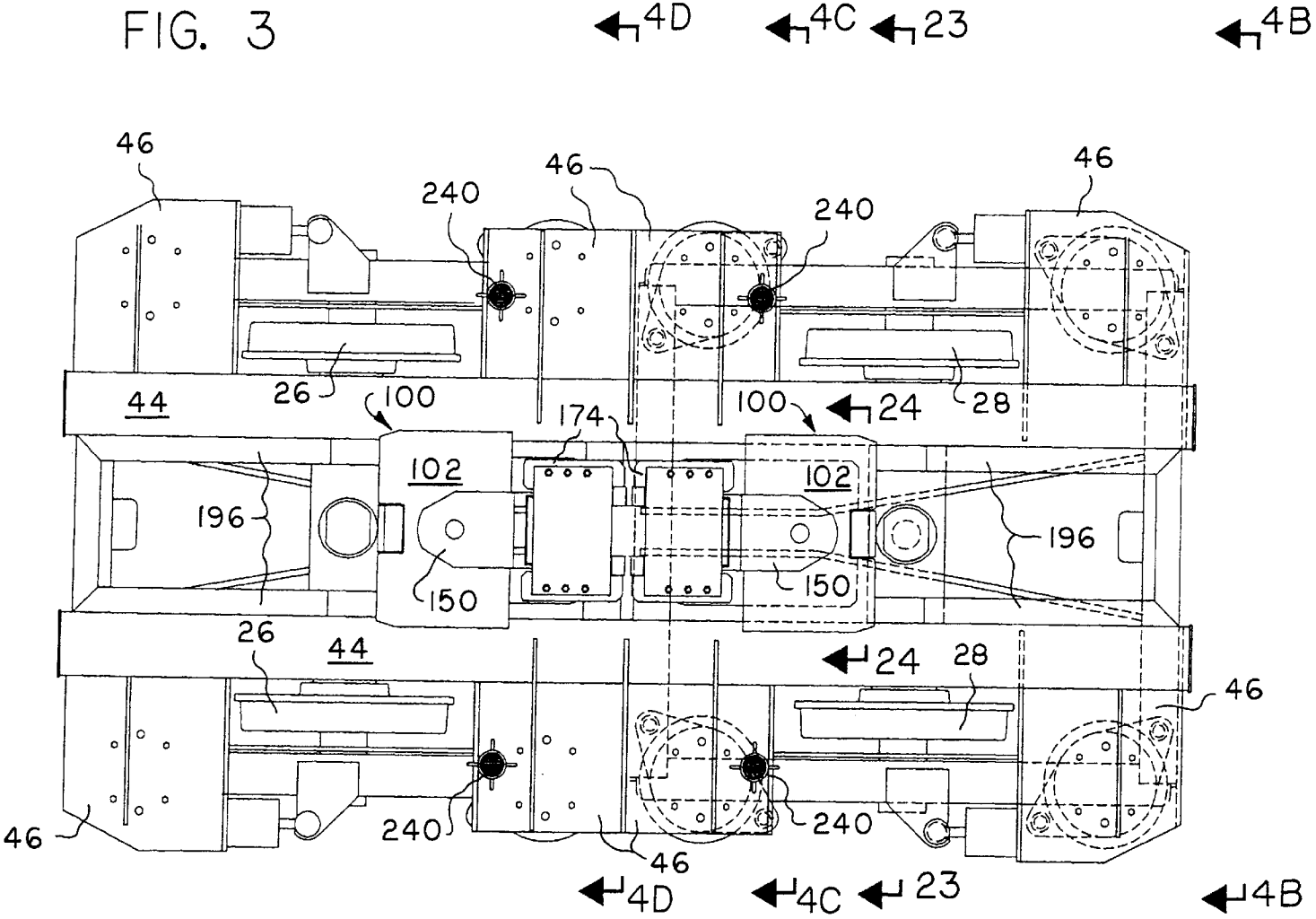
FIG. 3 is the intermodal vehicle including a top frame and leading and trailing lower frames.
Figure 4:
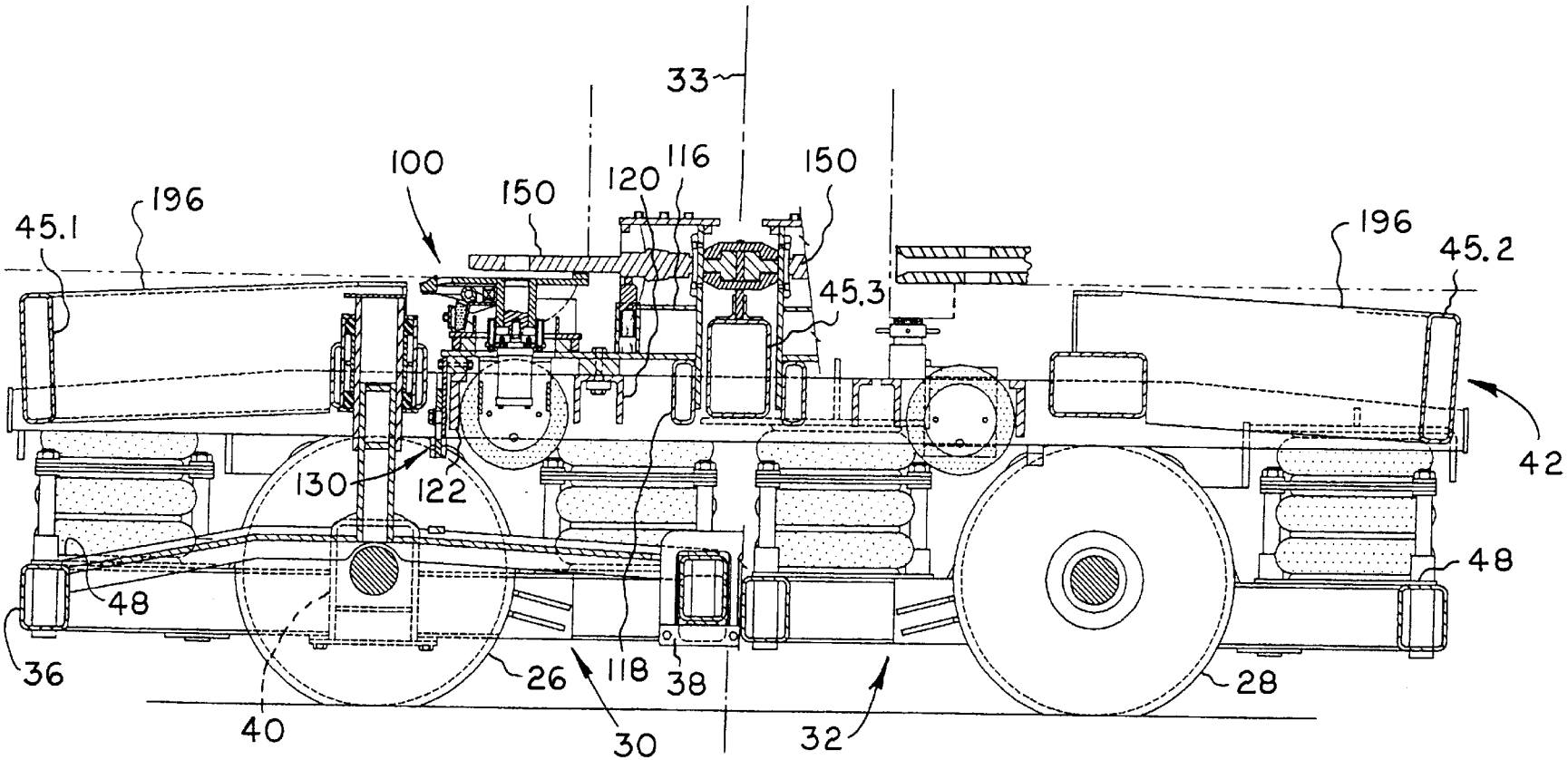
FIG. 4 is a sectional view of the intermodal vehicle shown in FIG. 3.
Figure 4A:
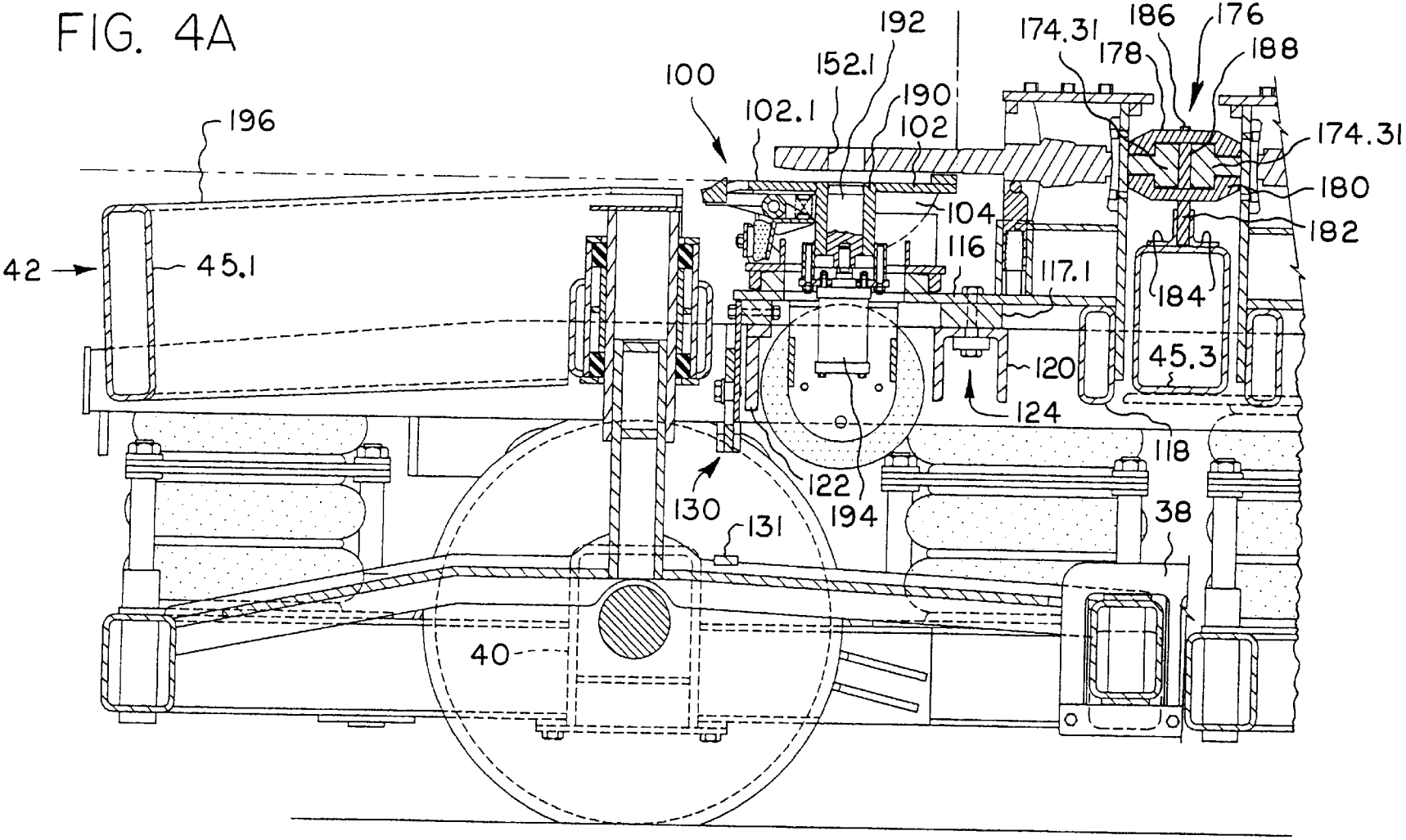
FIG. 4A is an enlarged portion of FIG. 4.
Figure 4B:
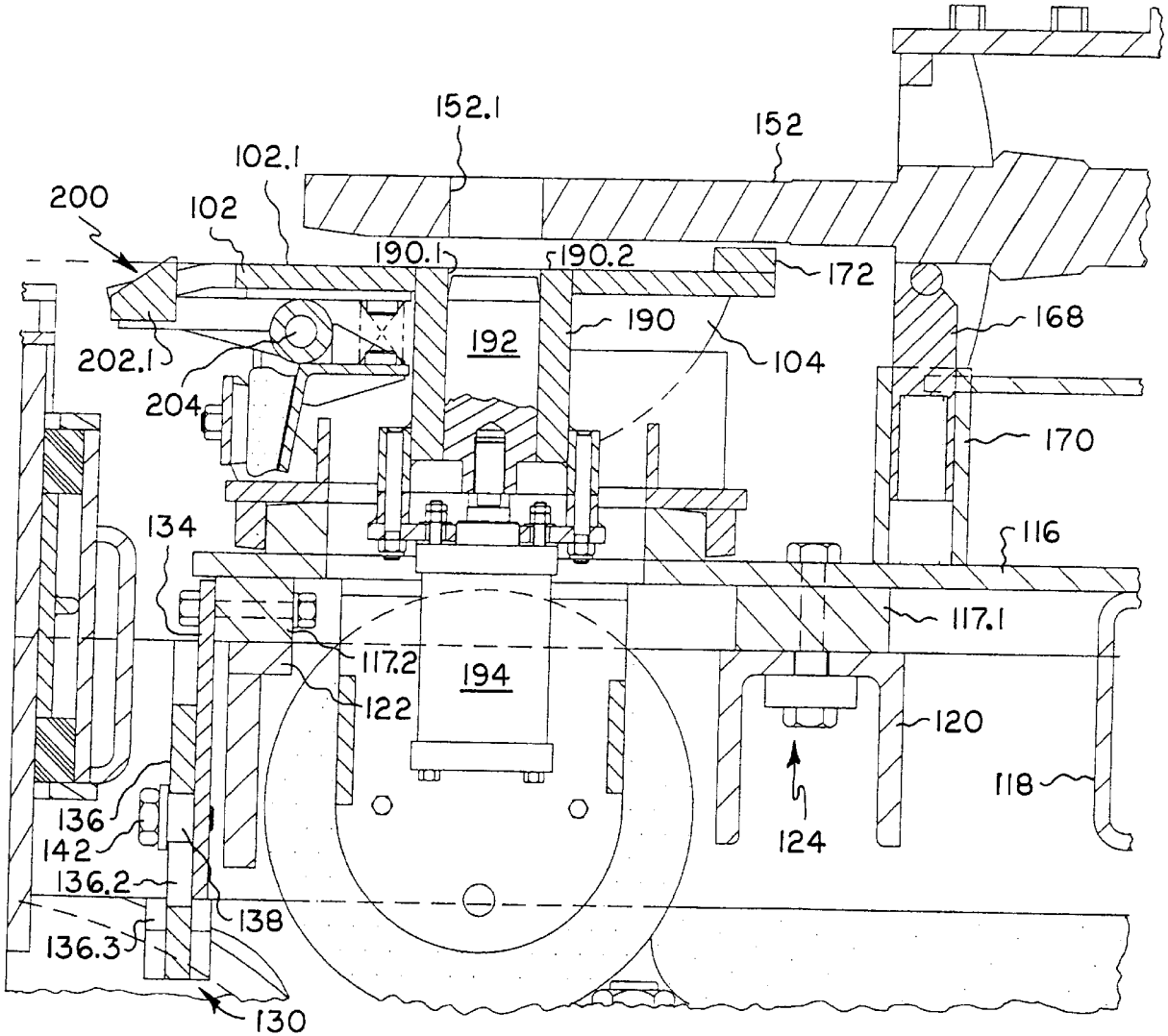
FIG. 4B is a further enlarged portion of FIG. 4.
Figure 4C:
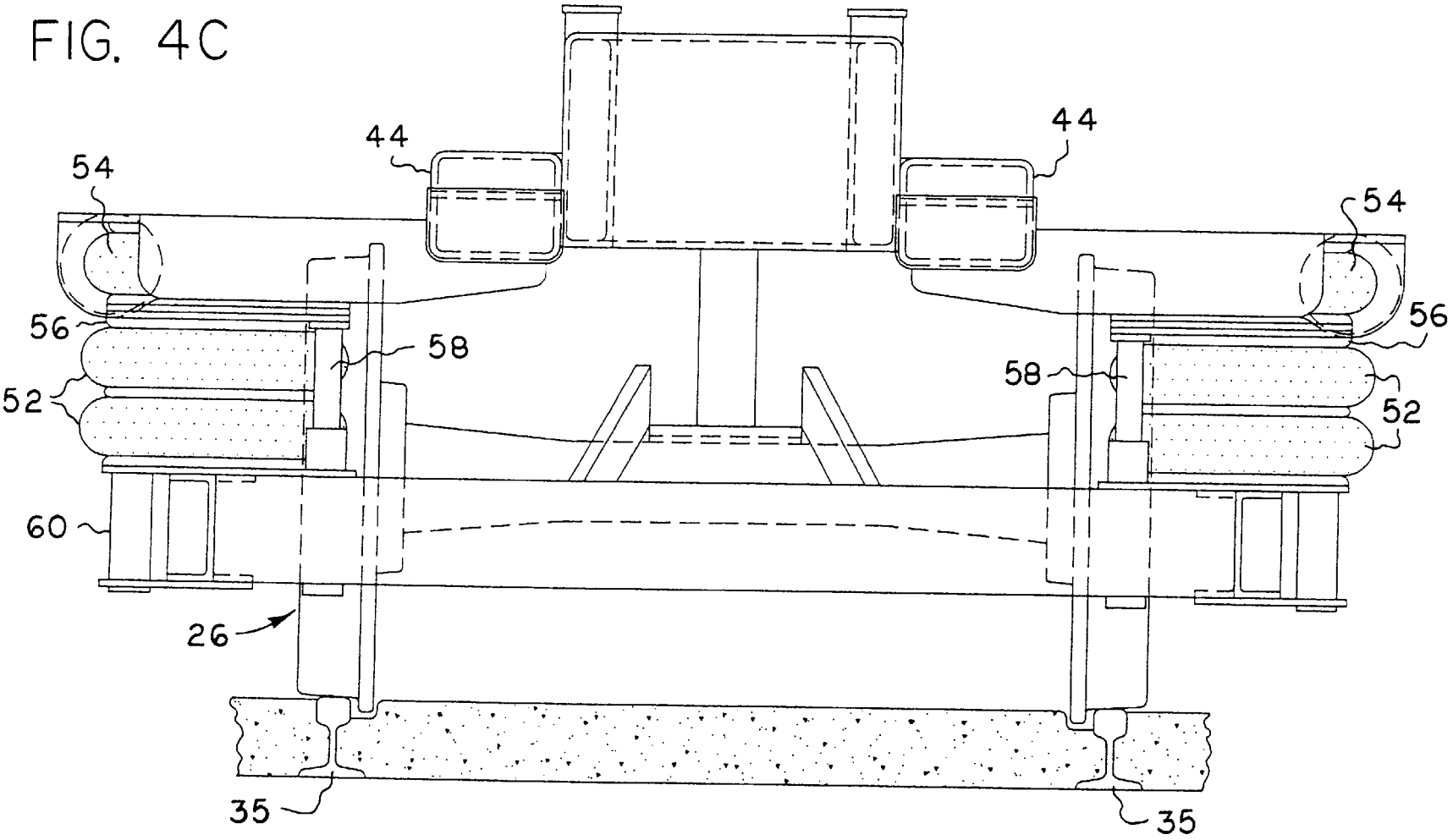
FIGS. 4C–4E are end and sectional views taken generally along the lines 4C—4C, 4D—4D and 4E—4E in FIG. 3, parts not being shown in FIGS. 4D and 4E for purposes of clarity.

With reference now to FIGS. 3 to 5A, each of the intermodal rail vehicles of this invention include leading and trailing rail axle/wheel assemblies, 26, 28, respectively, which are in turn supported by leading and trailing lower frame means indicated generally at 30, 32, respectively. As each of the rail vehicles is bi-directional, being symmetrical about the transverse centerline 33 best shown in FIGS. 3B and 5, the term leading and trailing is used for convenience only. Thus, with reference to FIG. 1, the wheels to the left may be considered the leading wheels. Each of the lower frame means include a pair of longitudinal side frames 34 which are parallel to rails 35 (FIGS. 4C–4E) and transverse frames 36 (FIG. 3). A reaction link 38 interconnects adjacent transverse frames. The axle/wheel assemblies are in turn supported in the side frames by bearings within bearing supports 40. While the lower frames 30, 32 are structurally different from that shown in WO 94/21503, they are essentially the functional equivalents thereof.

Figure 3A:
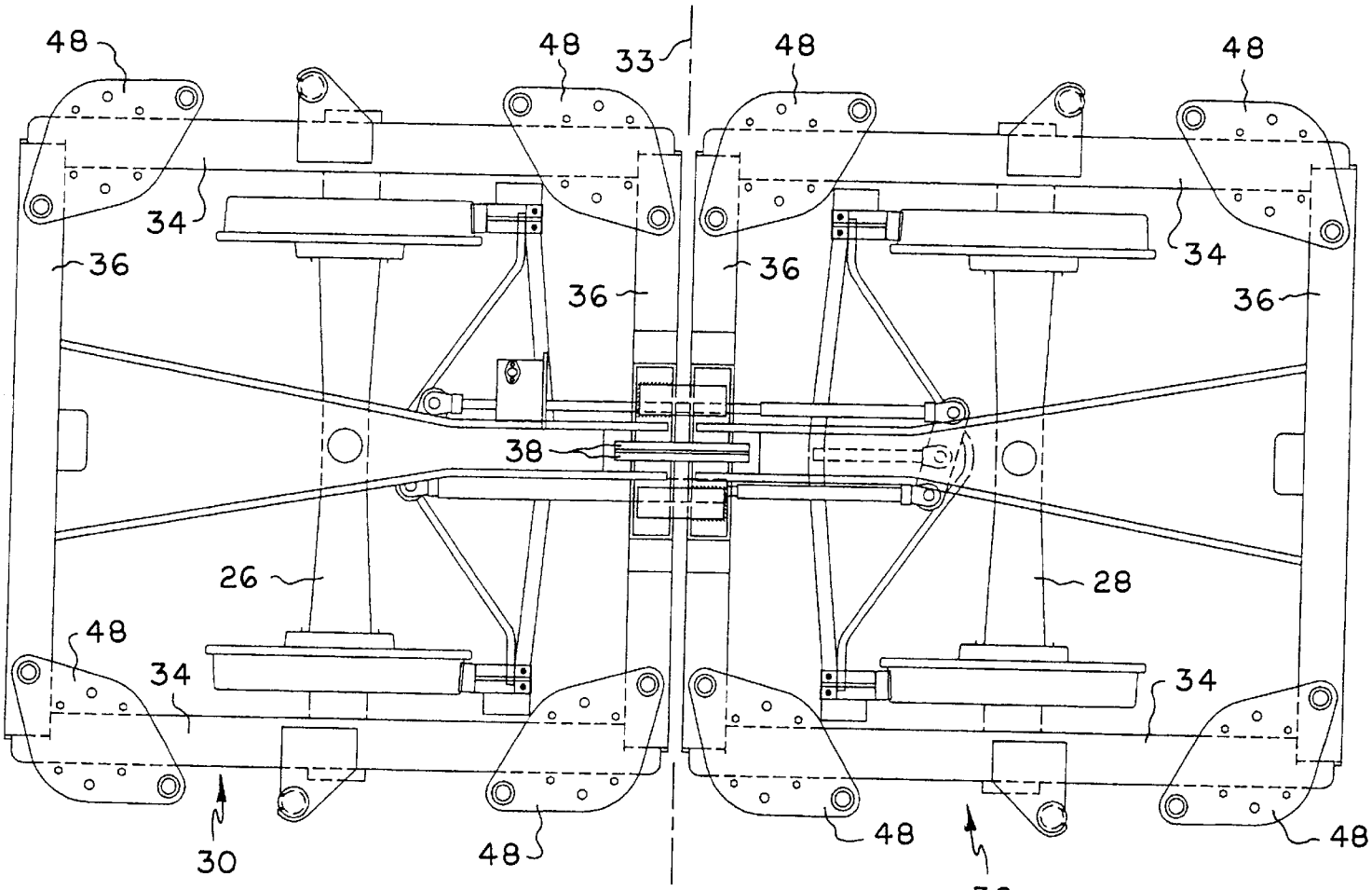
FIG. 3A is a view similar to FIG. 3 but not showing the lower frame.

Disposed above the lower frame means 30, 32 is an upper lifting frame means indicated generally at 42. The upper lifting frame means includes a pair of longitudinally extending beams 44, and transversely extending leading, trailing and intermediate beams 45.1, 45.2, and 45.3, respectively. The upper lifting frame further includes laterally outwardly extending spring mounting plates 46, there being two plates associated with each wheel of each axle wheel assembly. Thus, one of the upper beams 44 has welded thereto four upper spring mounting plates, two of them being positioned before wheels and two being positioned after wheels as best shown in FIG. 3. Similarly, each of the side frames of each of the lower frame means 30, 32 also carries lower spring mounting plates 48 before and after an associated wheel, the spring mounting plates 48 carried by the side frames 34 of the lower frame means being in vertical alignment with the spring mounting plates 46 carried by the upper frame beams 44. Each of the spring mounting plates has two ears 48.1 and 48.2 (FIG. 7A) which are disposed 180 degrees apart from each other, the function of which will be discussed later. It should be noted that in this invention, as contrasted with the invention shown in WO 94/21503, there are two air spring assemblies for each rail wheel or a total of eight air spring assemblies for each intermodal vehicle as opposed to four in WO 94/21503. As each spring assembly, which is indicated generally at 50, has a lifting capacity of approximately 16,200 lbs. at 100 psi, all of the spring assemblies have a lifting capacity of approximately 129,600 lbs. at 100 psi. As can best be appreciated from FIGS. 3 and 3A, a spring assembly is mounted at each corner of each of the generally rectangular lower frames 30, 32.

Figure 6:
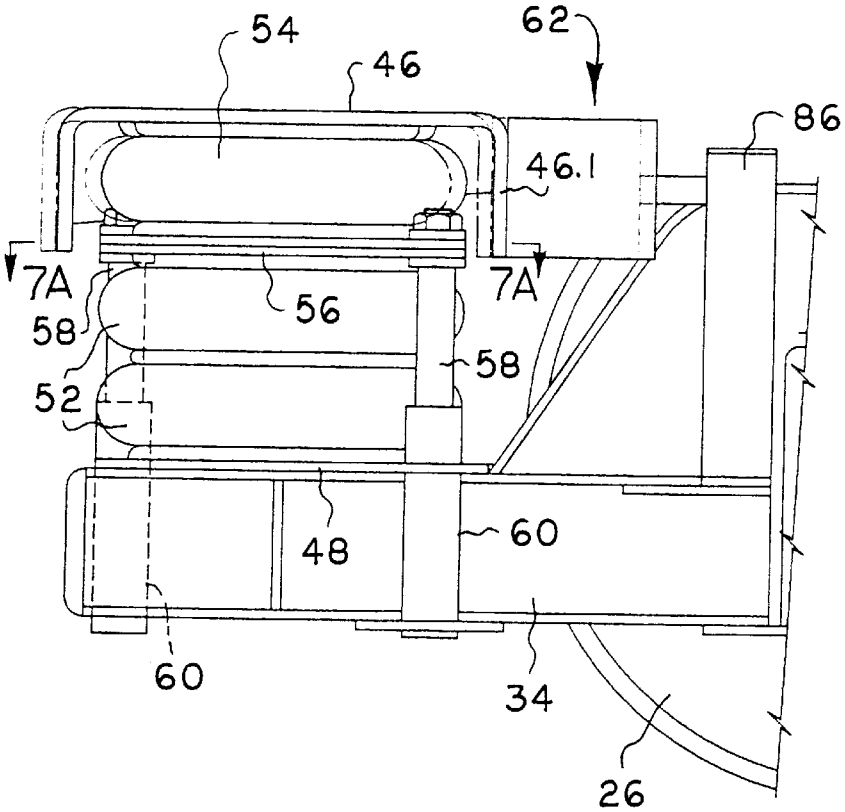

It is a further feature of this invention that a novel air spring assembly design is employed. Thus, each of the spring assemblies consists of a single two-convolution spring 52 and may further include a single one-convolution spring 54 (FIG. 6). The two springs 52 and 54 of each spring assembly are secured on top of each other, with the one-convolution spring being disposed above the two-convolution spring. A mounting plate 56 is disposed between the two springs 52, 54. The mounting plate 56 is provided with two ears similar to the ears 48.1 and 48.2 on the lower mounting plate, which ears are disposed 180 degrees apart from each other. Each ear receives the upper end 58 of a telescoping strut, the lower end 60 of the telescoping strut being secured to the ears on the lower spring mounting plate. As can be seen from a comparison of FIGS. 6 and 7, the upper strut 58 telescopes within the lower strut 60 and, therefore, the struts 58, 60 vertically guide the upper mounting plate. However, there is no such guide for the one-convolution spring 54, and therefore it may move from side to side in a horizontal plane.

Figure 4D:
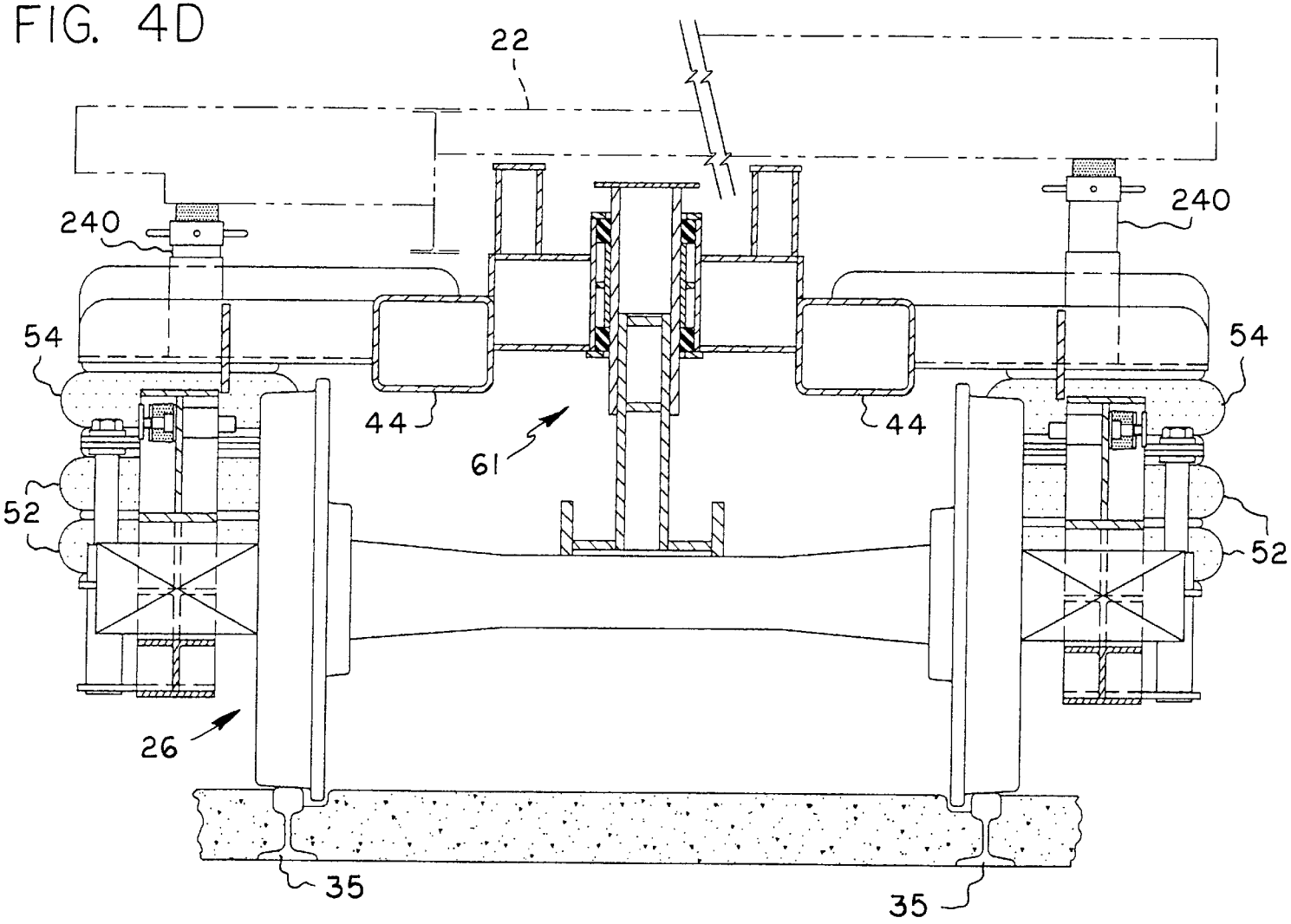
Figure 4E:
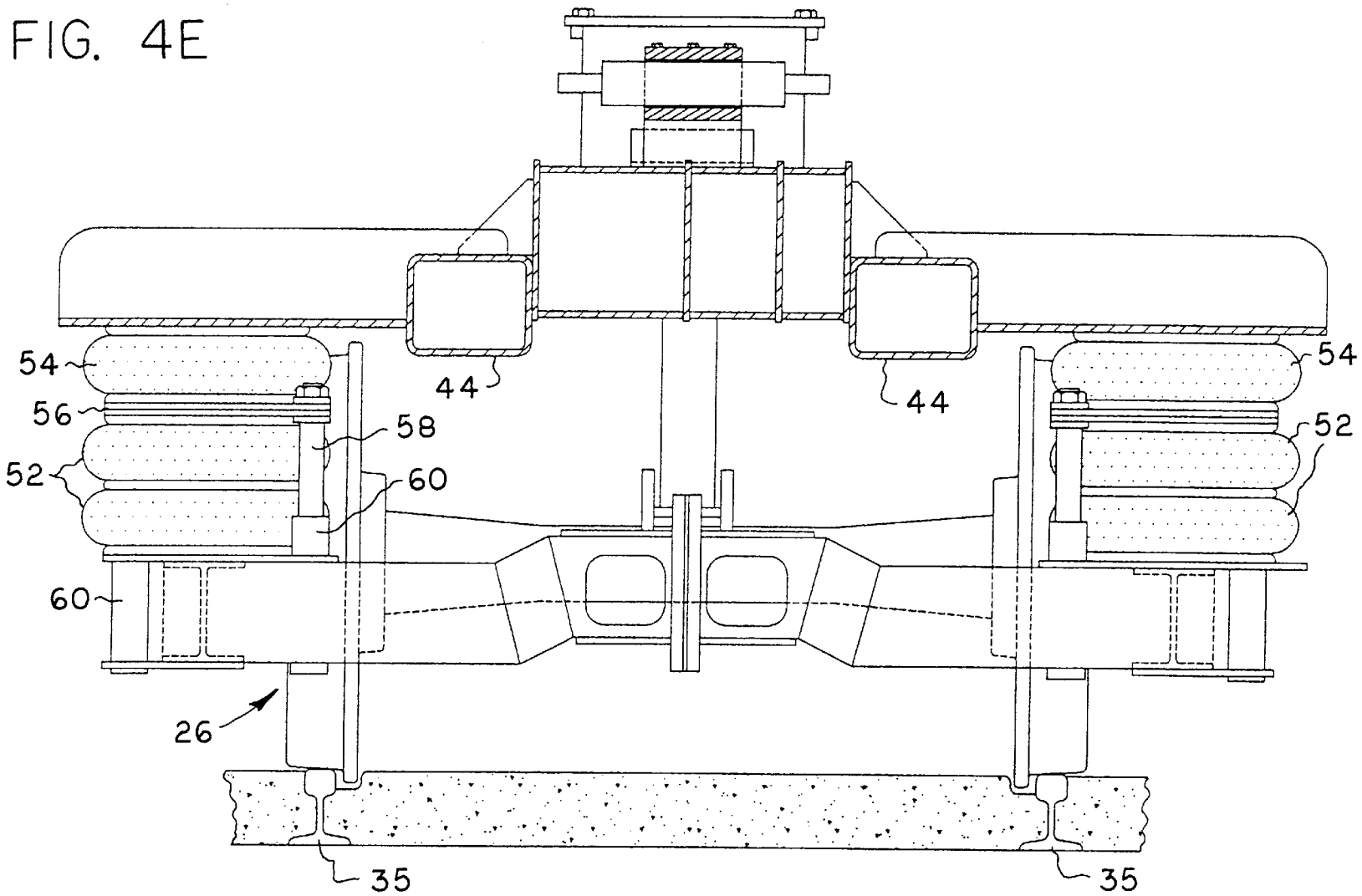
Figure 7:
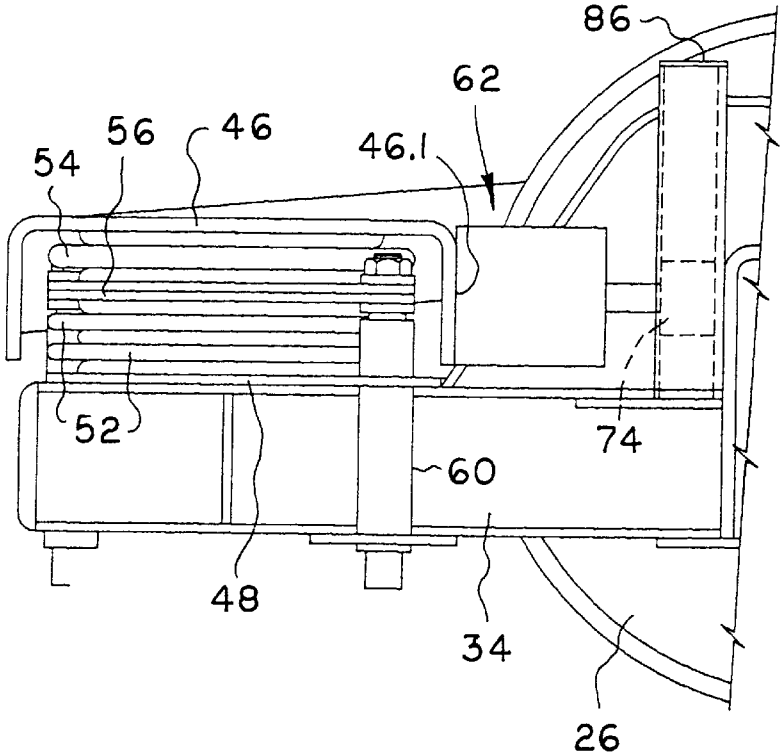
FIGS. 6 and 7 show a single spring assembly, FIG. 6 showing the spring assembly in the raised fully extended position, and FIG. 7 showing the same spring assembly in its lowered position.
Figure 7A:
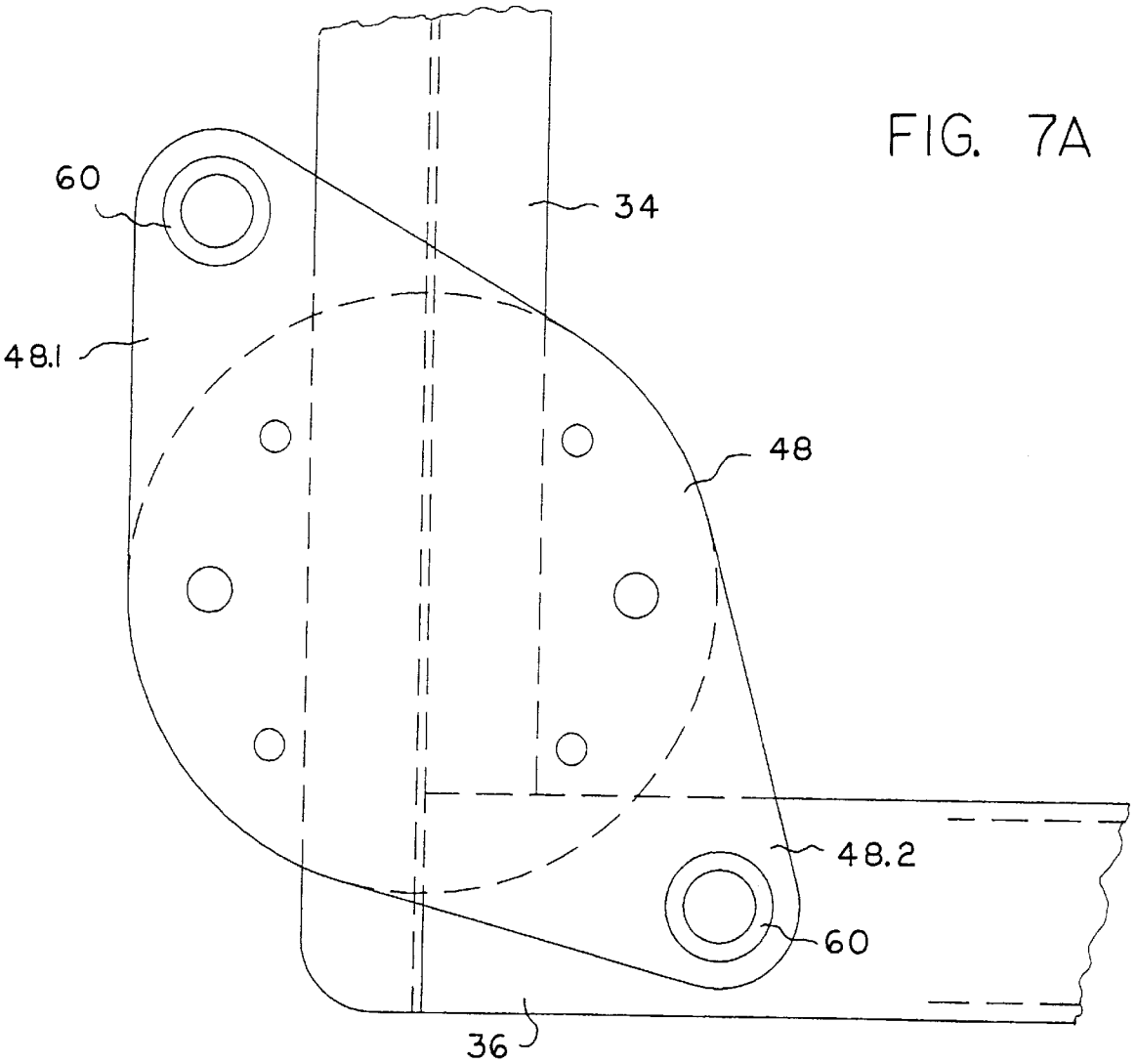
FIG. 7A is a section taken generally along the line 7–7 in FIG. 6, parts being eliminated for clarity.
Figure 8:
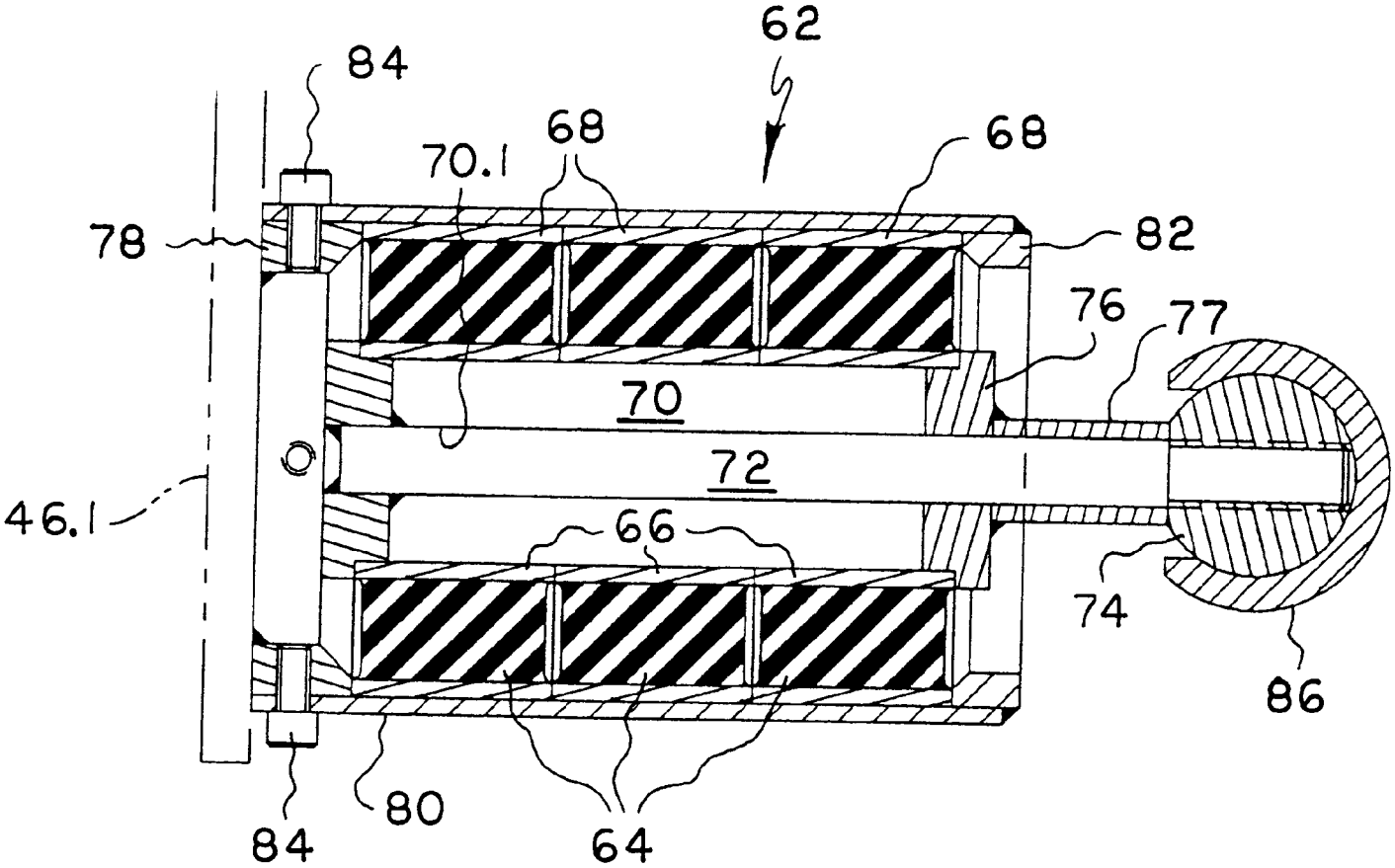
FIG. 8 is a cross sectional view of a steering damper.

Steering means, indicated generally at 61 in FIG. 4D, are provided for steering each of the lower frames 30, 32 with respect to the upper frame. The steering means are of the same type shown in WO 94/21503, and will not be described further. As previously noted, WO 94/21503 discloses the use of steering dampers (96 in WO 94/21503). However, it is a feature of this invention that novel steering dampers are provided. These steering dampers, which are indicated generally at 62, are best shown in FIGS. 6, 7 and 8. Each steering damper consists of annular rubber members 64 which are bonded onto an inner sleeve 66 and an outer sleeve 68, respectively, a plurality of annular rubber members being stacked together. The inner sleeve 66 is secured to a mounting bar 70 of circular cross section, the mounting bar in turn being provided with an internal bore 70.1, circular in cross section, and a threaded bore 70.2 at the other end. A mounting stud 72 extends through the bore 70.1. A steel cylinder 74 is carried by one end of the mounting stud 72, the steel cylinder being secured in place in any desired manner. A spacer assembly 76 is disposed between the cylinder 74 and the mounting bar 70, the spacers of the spacer assembly being provided with suitable bores to receive stud 72. A collar 78 is welded to the downturned side 46.1 of the spring mounting plates 46 as best shown in FIG. 8. A mounting cylinder 80 which has an internal diameter just slightly larger than the external diameter of the collar 78 and outer sleeve 68 is used to trap the outer sleeve in an assembled position. To this end, the mounting cylinder is provided with an inner annular member 82 which can bear against one end of the outer sleeve 68. The other end of the outer sleeve 68 is forced into engagement with the collar 78 and is held in place by bolts 84. By proper selection of the rubber, which may be formed from a natural rubber compound having a durometer of approximately 80 on the Shore A scale, and which may have an internal diameter of 2" and an external diameter of 6½", it is possible to achieve 15,000 lbs. force by 1" of movement of the stud 72. As can be seen from FIGS. 6 and 7, the steel cylinder 74 is received within a mounting guide 86. Thus, as the upper lifting frame 42 moves vertically with respect to the lower frames 30, 32, the cylinder 74 will travel vertically within the mounting guide 86. However, should the upper lifting frame move away from its normal centered position, considerable restoring force will be applied by the damper.

Figure 14:
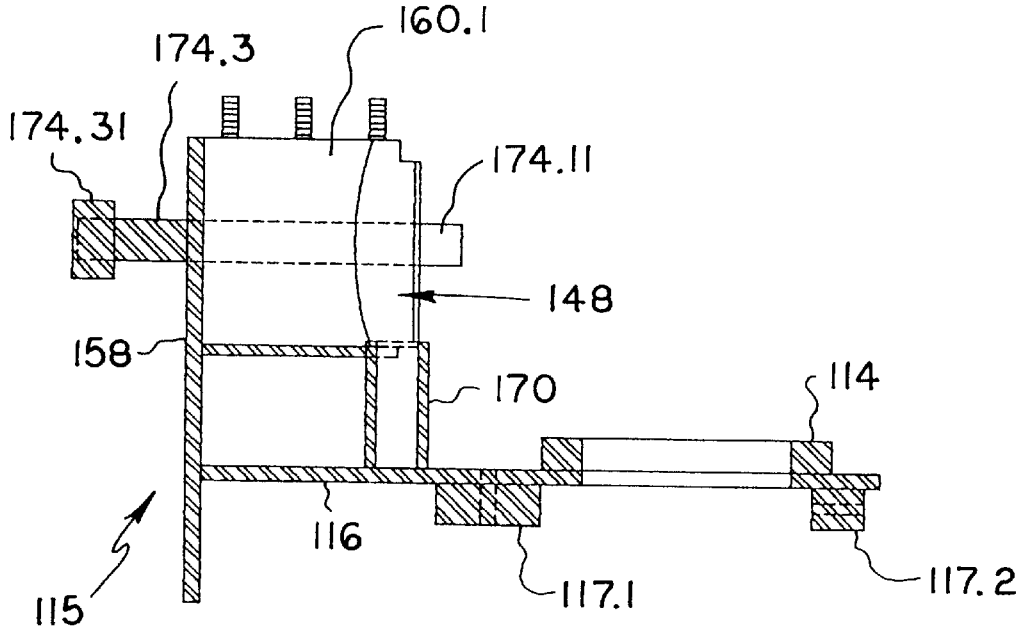
Figure 15:
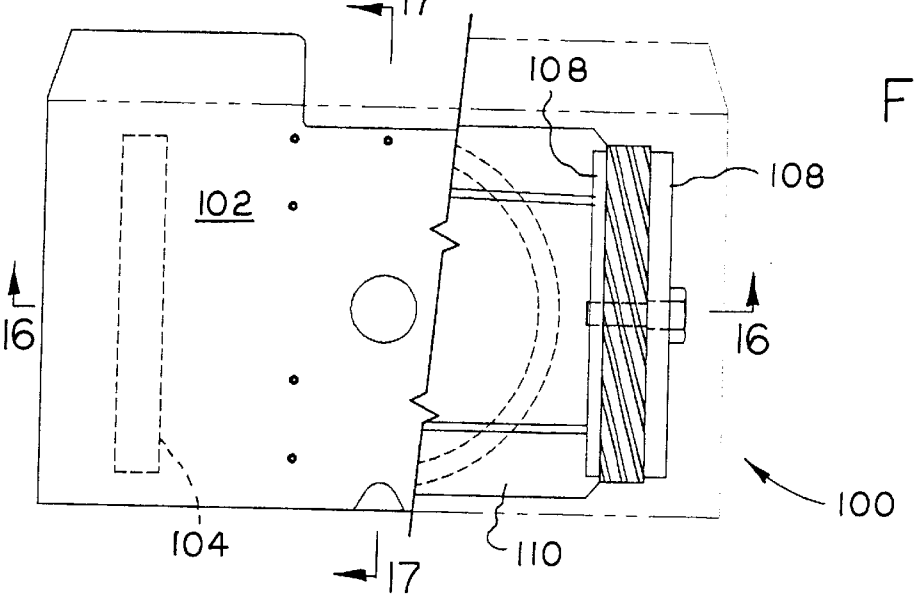
FIGS. 15, 16, and 17 show additional details of the trailer support structure assembly.
Figure 17:
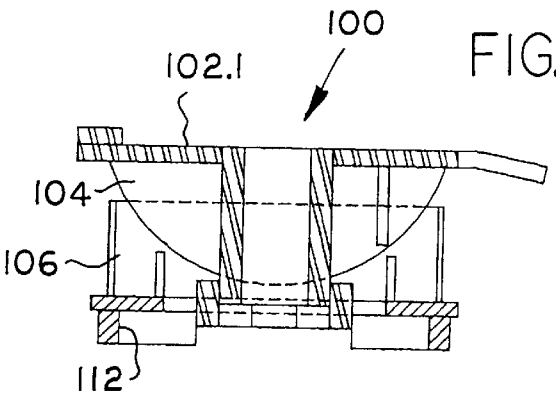

The upper lifting frame means 42 is provided with leading and trailing upwardly presented substantially identical load carrying structures indicated generally by the reference numeral 100. Each upwardly presented load carrying structure includes a generally rectangular trailer support plate 102 (FIG. 4A) having an upper trailer support surface 102.1. The support plate is supported upon the upper frame means for rocking, rotational, and side-to-side movement. To this end, a pair of transversely spaced apart half-moon side plates or rockers 104 are welded or otherwise rigidly secured to the bottom of the plate 102. These rockers are in turn supported for rocking movement by rocker supports 106 (FIGS. 16, 17 and 23), the rockers 104 being maintained in contact with the rocker supports 106 by inner and outer guide plates 108. The rocker supports 106 are in turn interconnected with an intermediate plate 110 which has a downwardly extending ring 112 secured thereto, the ring 112 being positioned about an inner ring 114 which is a portion of a coupler base weldment indicated generally at 115 and best shown in FIG. 14. Thus, the ring 114 is welded to a trailer support base plate 116.

Figure 23:
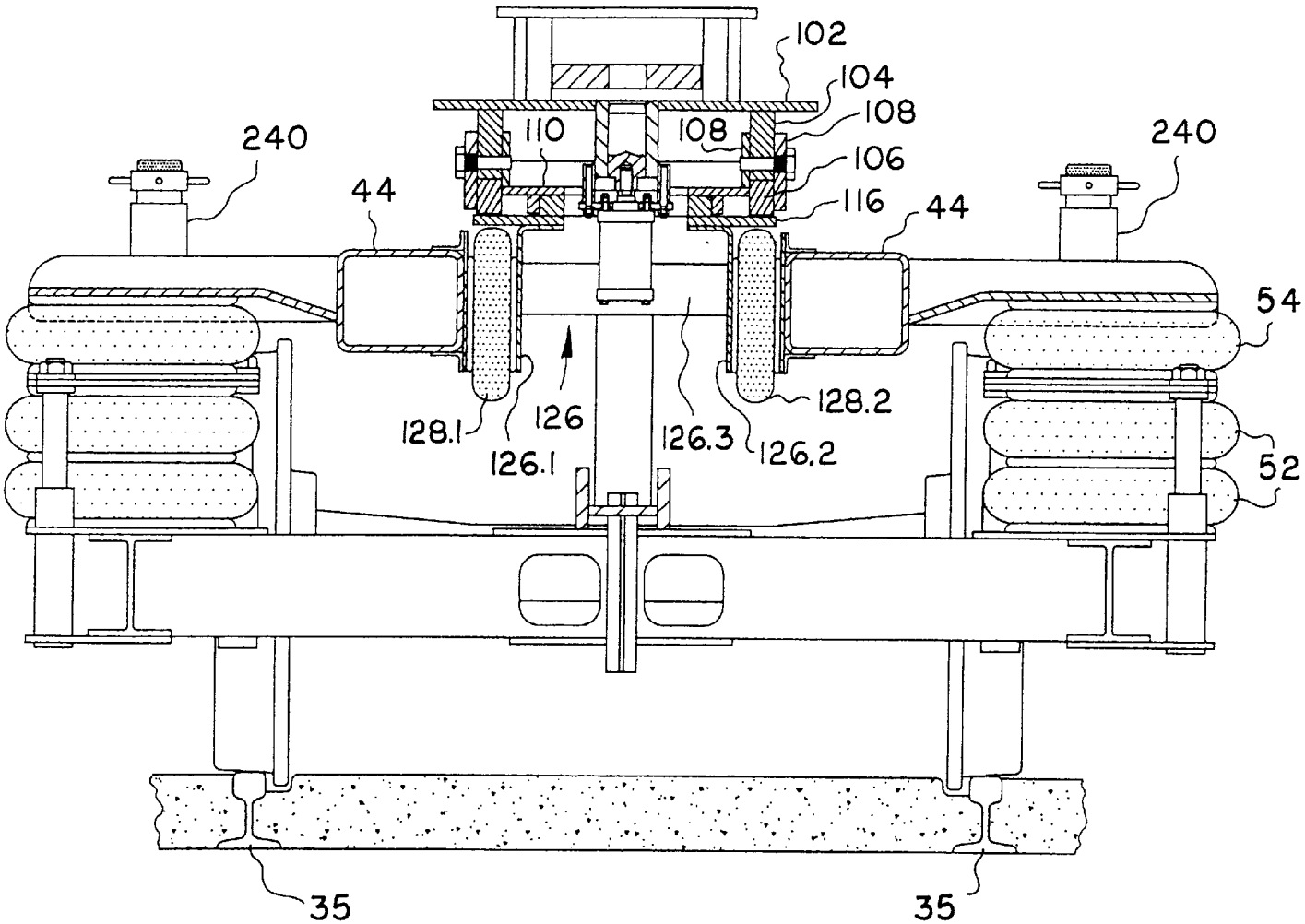
FIG. 23 is a section taken generally along the line 23—23 in FIG. 3, and shows how the trailer supports are transversely actuated by air spring units.
Figure 23A:
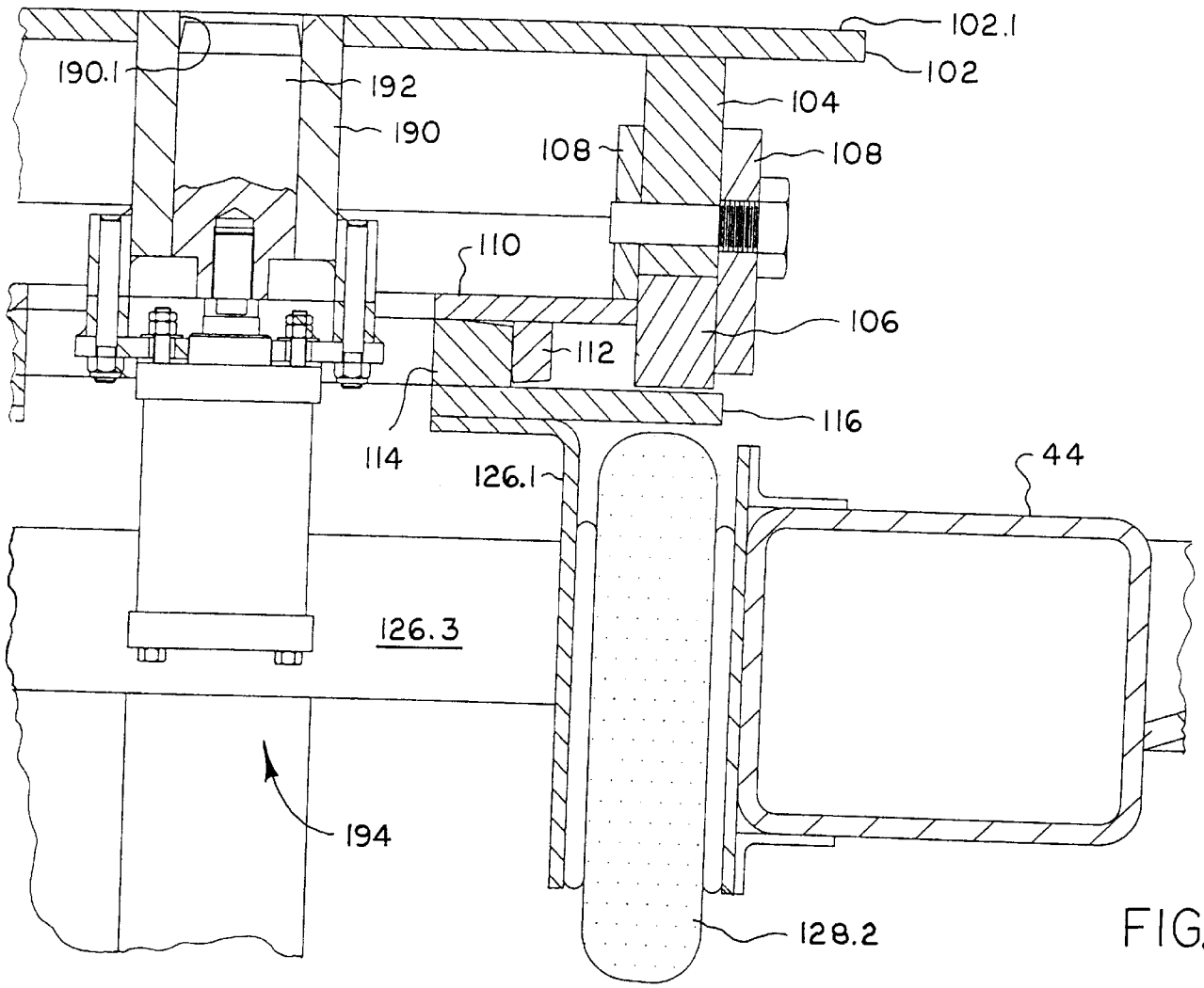
FIG. 23A is an enlarged portion of FIG. 23.

As can best be appreciated from an inspection of FIGS. 4 and 4A, each of the trailer support base plates 116 is mounted for transverse movement on cross frame members 118, 120, 122 of the upper lifting frame; frame member 120 being provided with a transverse slot (no number) which receives a guide assembly indicated generally at 124 (FIG. 4A). While plate 116 rides directly on cross frame member 118, the weldment 115 includes transverse support bars 117.1 and 117.2 which ride upon the cross frame members 120, 122, respectively. In order to facilitate controlled side-to-side movement, a force transmitting frame weldment indicated generally at 126 in FIG. 23 is mounted below the trailer support base plate 116. The weldment consists of L-shaped side plates 126.1 and 126.2 which are fastened to the bottom of plate 116, and a transverse brace 126.3. Disposed between the frame assembly 126 and the upper frame beams 44 are first and second air actuators 128.1 and 128.2. As can best be appreciated from an inspection of FIG. 23, when the first actuator 128.1 is charged with compressed air, it will expand and move the coupler base weldment 115 sidewards through the force applied to force transmitting frame assembly 126. The second actuator 128.2, when charged with air (and when air is discharged from the first actuator 128.1), will move the coupler base weldment the opposite way. This sideward movement of the coupler base weldment assists in positioning the trailer on top of the load carrying structures 100.

Figure 5:
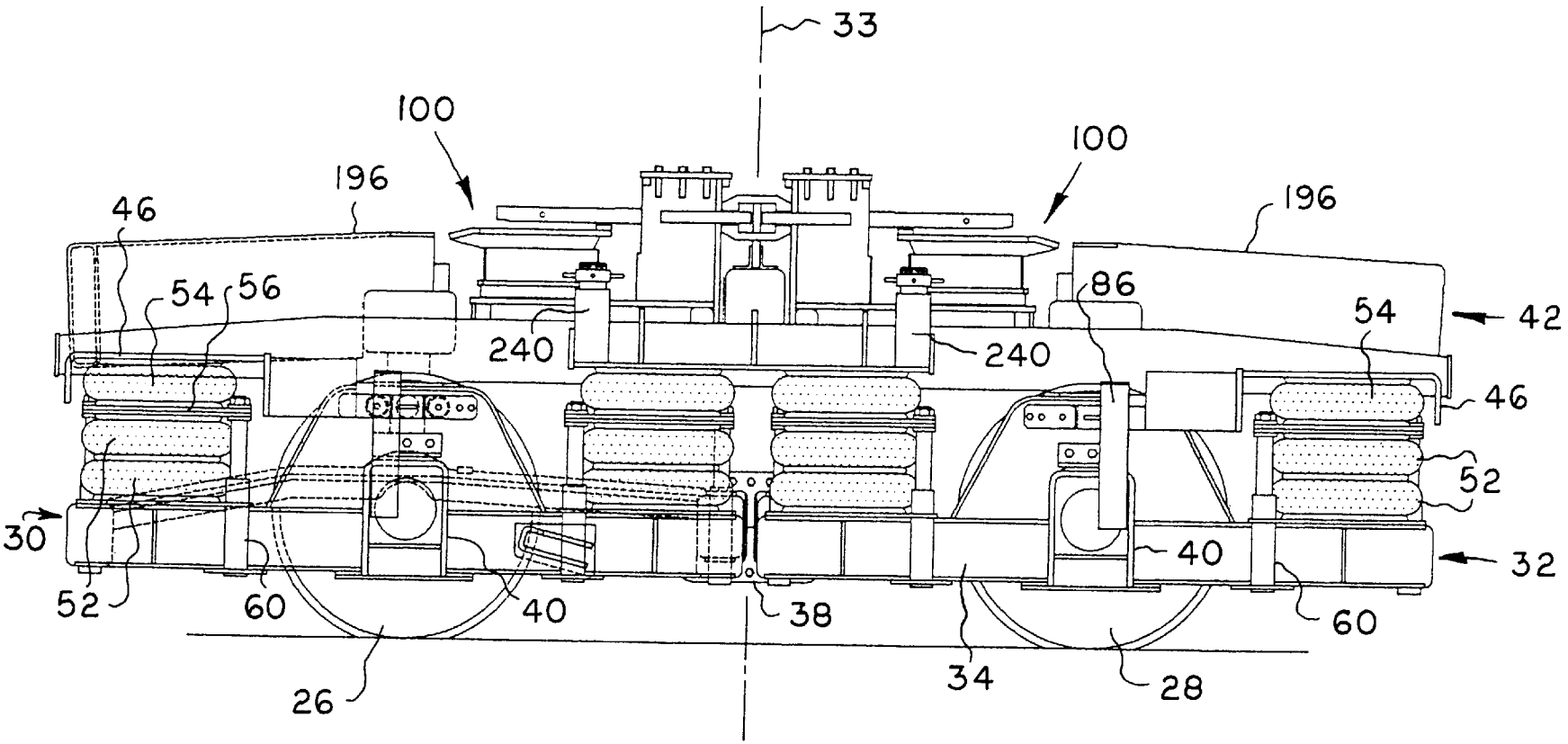
FIGS. 5 and 5A are side elevational views of the intermodal vehicle shown in FIG. 3, FIG. 5 showing the intermodal rail vehicle in its raised position, and FIG. 5A showing it in its lowered position.
Figure 5A:
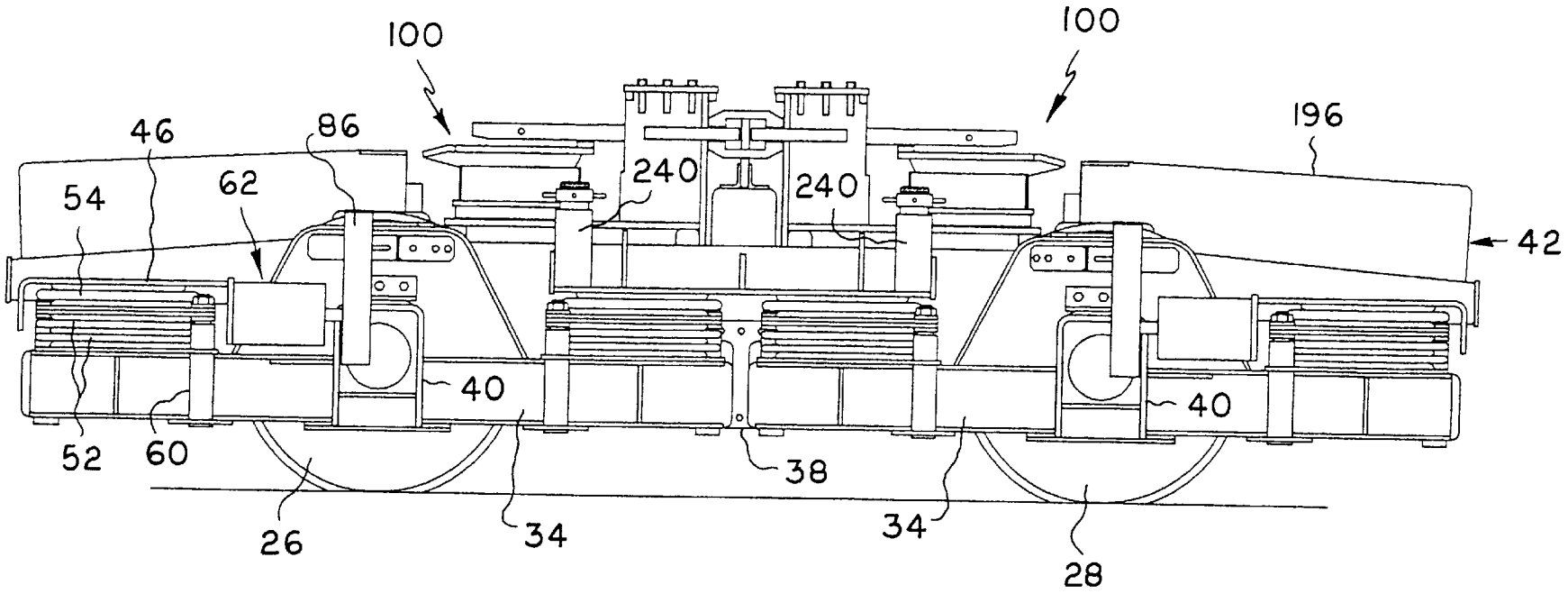
Figure 24:
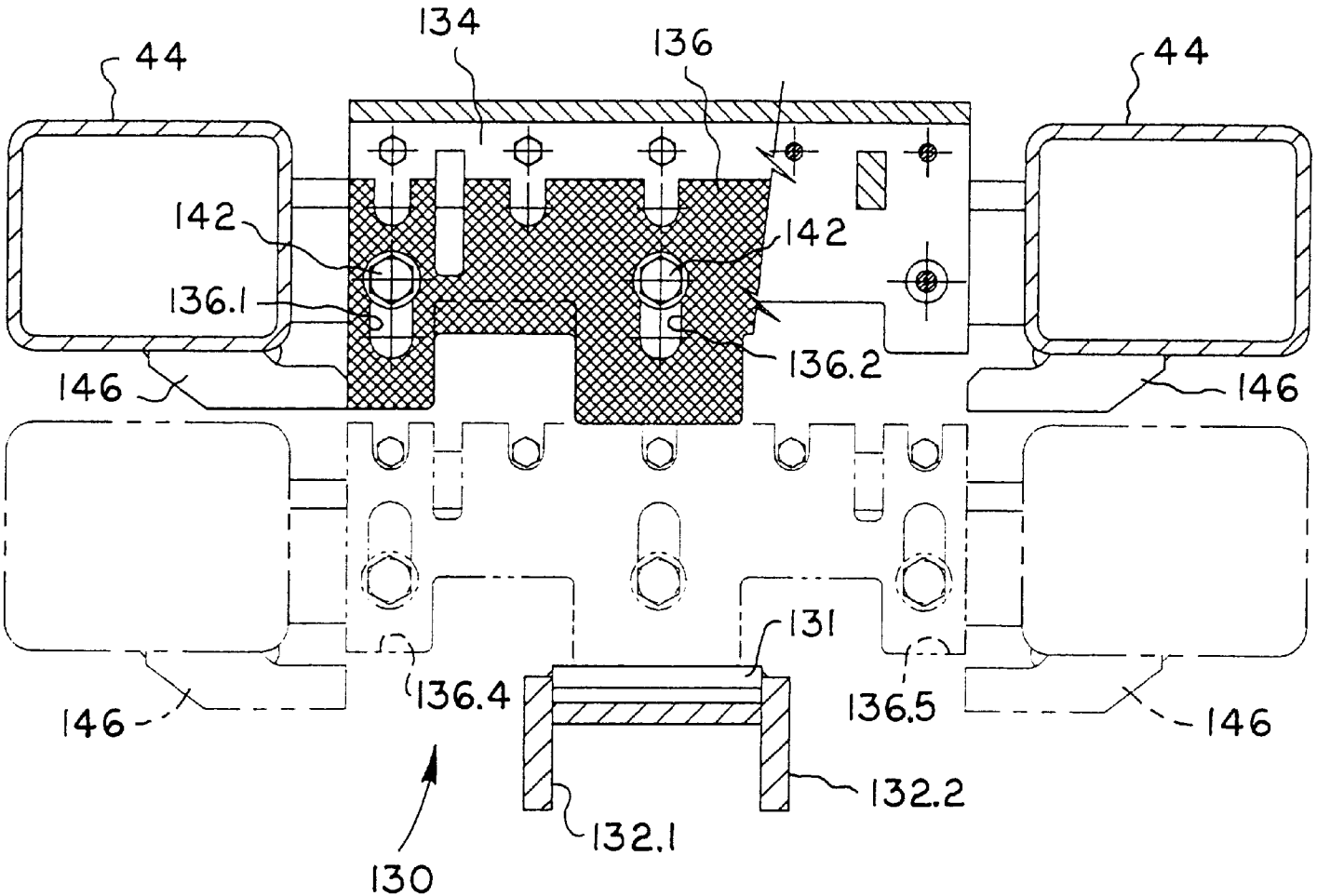
FIG. 24 shows the gravity operated coupling lock assembly, this view taken generally along the line 24—24 in FIG. 3.

In order to limit side-to-side movement only when the upper frame is in its lowered position shown in FIG. 5A, a coupling centering lock assembly, indicated generally at 130 (FIGS. 4A, 4B and 24) is provided. This centering lock assembly cooperates with a transverse member 131 carried by right and left longitudinally extending members 132.1 and 132.2 of the lower frame. The lock assembly includes a downwardly extending plate 134 which is rigidly secured to the transverse support bar 117.2 by a fastener. The lock assembly further includes a lock plate 136 which is slidably supported on the downwardly extending plate 134. To this end, the lock plate is provided with a pair of laterally spaced apart vertically extending apertures 136.1, 136.2, each of which slidably receive a spacer 138. One side of the spacer is positioned against the plate 134 and the other side is positioned against a surface 136.3 (FIG. 4B) of the lock-plate 136, the parts being held together by fasteners 142. The lower end of the lock plate 136 will cooperate with cams 146 carried by beams 44. The operation of the lock mechanism can best be appreciated from FIG. 24. Thus, when the upper frame is in its lowered position (shown in phantom lines), the lower surface of lock plate 136 will bear against the transverse member 131 causing the corners 136.4 and 136.5 of the lock plate 136 to be raised above the cams 146 permitting transverse movement. However, when the upper frame is in its raised position shown in full lines in FIG. 24, the lock plate will drop and will center between the two cams prohibiting transverse movement of the trailer support base plate 116.

Figure 10:
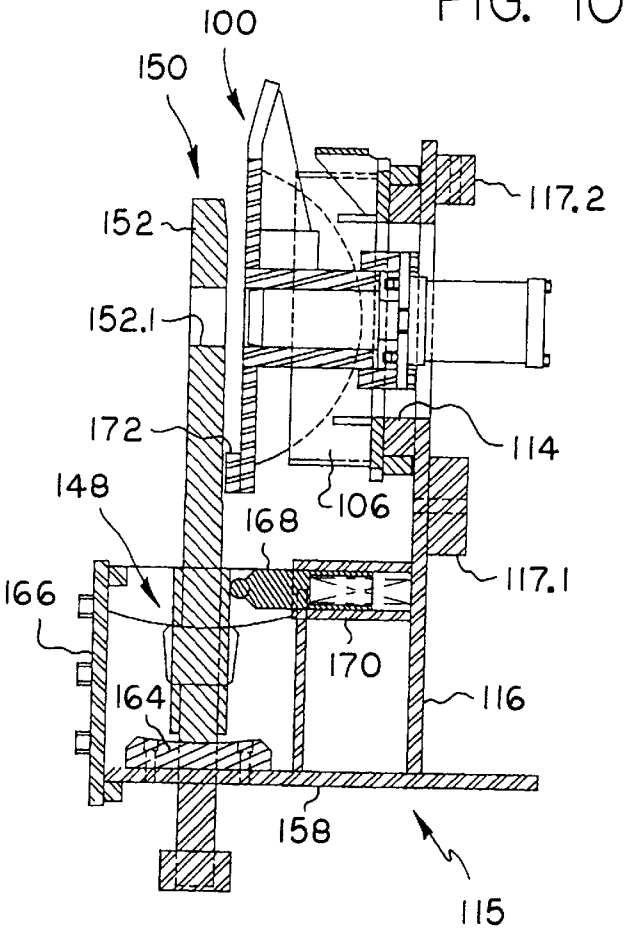
FIG. 10 is a sectional view taken generally along the line 10—10 in FIG. 9.
Figure 9:
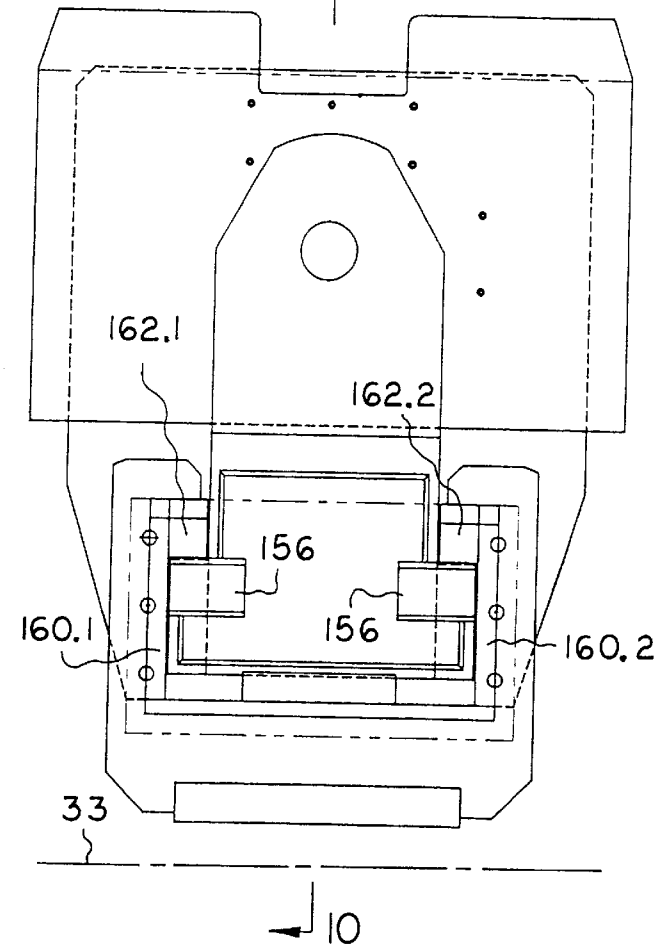
FIG. 9 is a plan view of a coupler tongue assembly, coupler tongue support, and load carrying structure.
Figure 11:
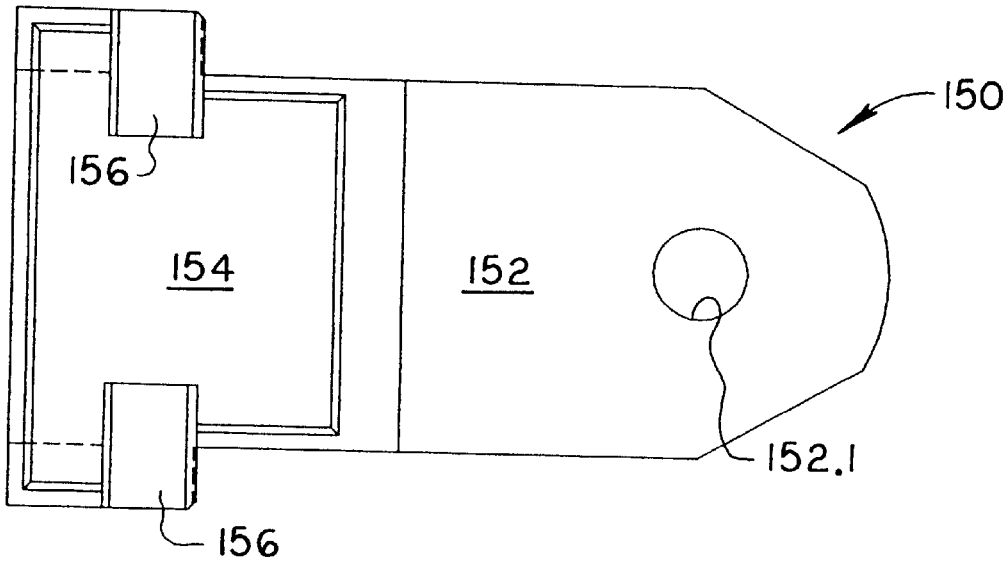
FIGS. 11 and 12 are plan and side elevational views of the coupler tongue weldment.
Figure 12:
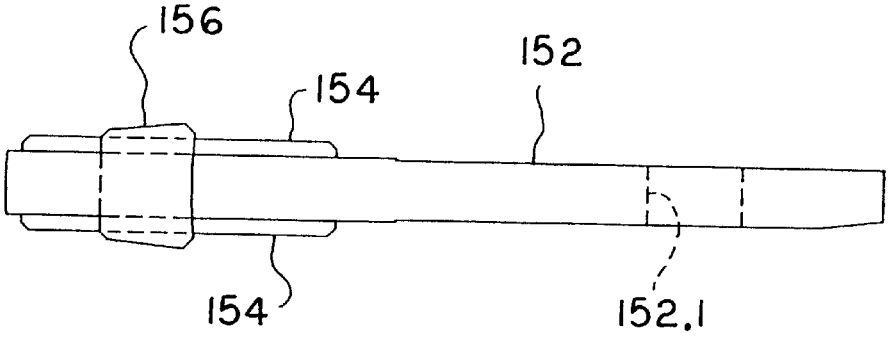
Figure 13:
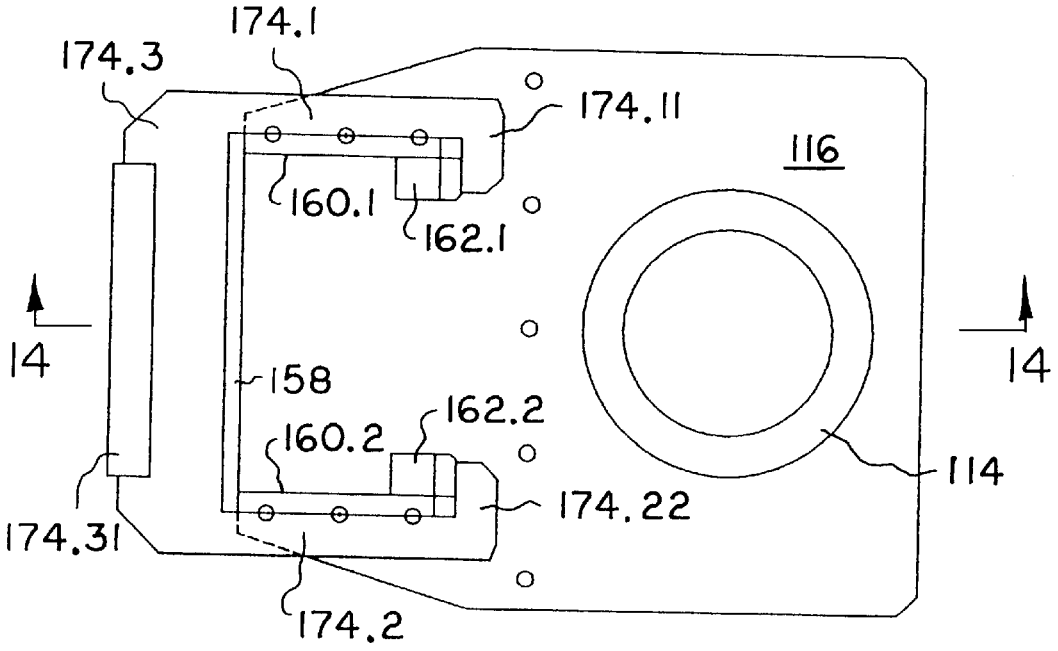
FIGS. 13 and 14 are plan and sectional views of the coupler base weldment, FIG. 14 being taken generally along the line 14—14 in FIG. 13.

The coupler base weldment 115 (FIG. 14) further includes a coupler tongue housing, indicated generally at 148, to be supported by the trailer support base plate 116 adjacent centerline 33 (FIG. 4A). The housing serves to support the apertured coupler tongue weldment 150 (FIGS. 10–12). The weldment includes a main tongue 152 which is provided with an aperture 152.1, doubler plates 154 (FIGS. 11 and 12) which are welded to the top and bottom sides of the main tongue, and pulling lugs or ears 156 which are also welded. As can best be seen from FIG. 11, the coupler tongue weldment has a generally T-shaped appearance when viewed from the top. The coupler tongue housing 148 includes a vertically extending plate 158. Spaced apart side plates 160.1, 160.2 (FIG. 13) are welded to the plate 158 and are spaced apart a distance sufficient to receive the portion of the coupler tongue weldment having the ears 156 as can best be seen from FIG. 9. At the inside ends of the side plates 160.1 and 160.2 are coupler tongue guides 162.1 and 162.2. It can be seen from FIG. 9 that the guides 162 restrain the movement of the ears 156 away from the centerline 33. The movement of the tongue towards the transverse centerline 33 is restrained by a guide block 164 (FIG. 10) which is mounted on wall 158 between the side walls 160.1 and 160.2. The tongue weldment is assembled within the C-shaped housing (formed by the vertical plate 158 and spaced apart side plates 160.1, 160.2) by merely dropping the eared portion of the tongue weldment 150 within the C-shaped housing and then by closing the upper end of the C-shaped housing by a cover plate 166 which is secured in place by suitable bolts.

A portion of the weldment 150 is supported at all times by a coupler tongue support 168 (FIGS. 4B and 10) in the form of a spring-biased pin, which can telescope within a vertical housing 170. In addition, another portion of the weldment 150 may be supported by a bar 172 carried on the trailer support plate 102. It can be seen from an inspection of the various figures which show the coupler tongue weldment that the coupler tongue weldment is supported for limited pivotal, rolling, and pitching movement.

As can be seen from FIGS. 3 and 4, it is a feature of the present invention that the leading and trailing coupler tongues 150 work together so that forces transmitted to one are directly transmitted to the other. In other words, the apertured leading and trailing coupler tongue weldments 150 act together as a continuous draw bar when they are connected to leading and trailing trailers. To this end, a U-shaped yoke assembly 174 is provided. The yoke assembly includes side members 174.1 and 174.2 (FIG. 13), provided with inturned ends 174.11 and 174.22, respectively, and bight section 174.3. The side members and bight section are welded to the side plates 160 and vertical plate 158. In addition, the bight section is provided with an enlarged portion 174.31, which is a channel shaped member welded to the bight portion.

As can best be seen from FIG. 4A, the leading and trailing bight portions 174.3 are interconnected to each other by a continuous draw link or shackle assembly indicated generally at 176. The shackle assembly includes an upper member 178 and a lower member 180. A downwardly extending transverse support member 182 is welded to the bottom side of the lower member 180 and is received within a pair of brackets 184, the brackets in turn being secured to the top of transverse beam 45.3. The support member 182 is secured within the brackets 184 by a conventional fastener, not shown. The upper and lower members 178, 180 are also secured together by a fastener 186. As can be seen from FIG. 4A, each of the members 178 and 180 are generally C-shaped in cross section. One or the other may be provided with an intermediate spacer 188 which is disposed between adjacent enlarged portions 174.31. Alternatively, the spacer may be a separate piece. It can be appreciated from an inspection of FIGS. 4 and 4A, that if a pulling force is exerted on the leading coupler tongue 150, that this same pulling force will be transmitted to the trailing coupler tongue 150 by the continuous draw link 176. Likewise, if a compressive force is exerted on the coupler tongue, as may happen during braking, the same compressive force will be transmitted through the link 176 to the trailing tongue 150. Thus, a continuous drawbar 150, 176 is provided.

When the tongue is assembled within the weldment 115, the aperture 152.1 in the tongue will overlie a corresponding aperture 190.1 (FIG. 4B) formed within a vertically extending sleeve 190 which receives a coupling pin 192. The sleeve 190 is suitably welded or otherwise rigidly secured to the plate 102 with its upper surface 190.2 lying in the same plane as surface 102.1. The coupling pin 192 is adapted to be moved from an initial at rest position shown in FIG. 4B, where the upper end of the coupler pin 192 is disposed slightly below the surface 102.1 of the plate 102, to a raised position where it will pass through the aperture 152.1 and corresponding apertures in a trailer socket assembly 22 or 24 to hold the socket assembly securely on the load carrying structure 100. The coupling pin is moved vertically by a double acting air cylinder assembly indicated generally at 194, the cylinder assembly being secured to the lower end of the sleeve 190. Any conventional double acting air cylinder 194 may be employed and therefore it will not be described further.

When assembling a trailer onto the intermodal rail vehicle of this invention, it is moved relatively towards the center of the vehicle until coupling can be achieved. For example, if a leading trailer 12 (FIG. 1) is to be assembled onto the intermodal rail vehicle 10, it will be moved to the right as viewed in FIG. 1, causing the trailing socket assembly 24 of the highway trailer to ride up upon a loading ramp 196 and then onto the surface 102.1 of the support plate 102. This movement will be continued until the leading edge of the socket assembly 24 abuts against the bar 172. At this time, a primary latch mechanism, indicated generally at 200 (FIG. 4B), will engage a portion of the socket assembly and hold it on the support plate 102 until such time as the pin 192 can secure the socket assembly to the intermodal rail vehicle.

As can best be seen from FIGS. 4A, 4B, 18, 21, and 22, the primary latch assembly consists of a latch weldment 202.1–202.4 rotatably mounted on a transversely extending pin 204 carried by a pair of depending ears 206 (FIG. 18) secured to plate 208. The plate 208 is in turn rigidly secured in any conventional manner to the trailer support plate 102. As can be seen from FIGS. 4B, 18, and 22, the latch has a hook portion 202.1 which is adapted to engage the side of a lug (not shown) carried by the coupler socket assembly 22. The hook portion 202.1 is carried by two spaced apart arms 202.11 and 202.12 which are welded at the end remote from the hook to a sleeve 202.4. The arms 202.11 and 202.12 are braced by gussets, only gusset 202.13 being shown. The hook portion 202.1 is normally biased to its upper position by springs 210 which are disposed between bosses 208.1 on the plate 208 and bosses 202.21 carried by a first lever 202.2 of the latch. The latch also includes a second lever 202.3 which is adapted to be engaged by an air bag 212 supported by a saddle assembly 214, the saddle assembly being in turn mounted upon the intermediate plate 110. When the socket assembly 22 is moved onto the plate 102, the latch will initially be cammed downward as the lug on the socket assembly passes over the hook portion 202.1. After the lug has completely passed over the hook portion, the springs 210 will force the hook portion upwardly with a loud click. When it is desired to move the trailer off the intermodal vehicle of this invention, it will be necessary to release the latch mechanism, and to this end the air bag is inflated which will cause the lever 202.3, as viewed in FIG. 22, to move in a counterclockwise direction, lowering the hook portion 202.1. The first and second lever portions 202.2 and 202.3 are formed from a single piece of angle iron which is welded to a sleeve portion 202.4 of the latch.

Figure 16:
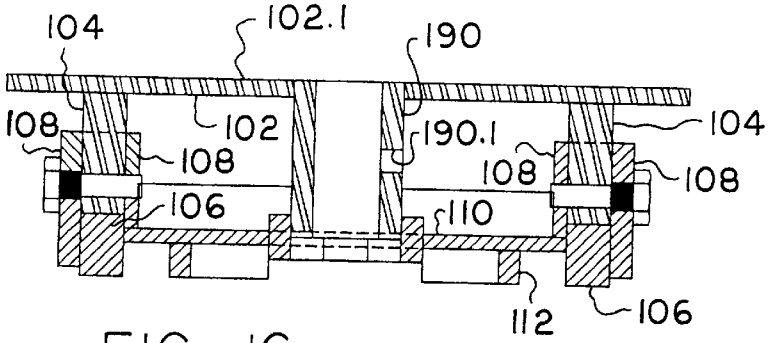
Figure 18:
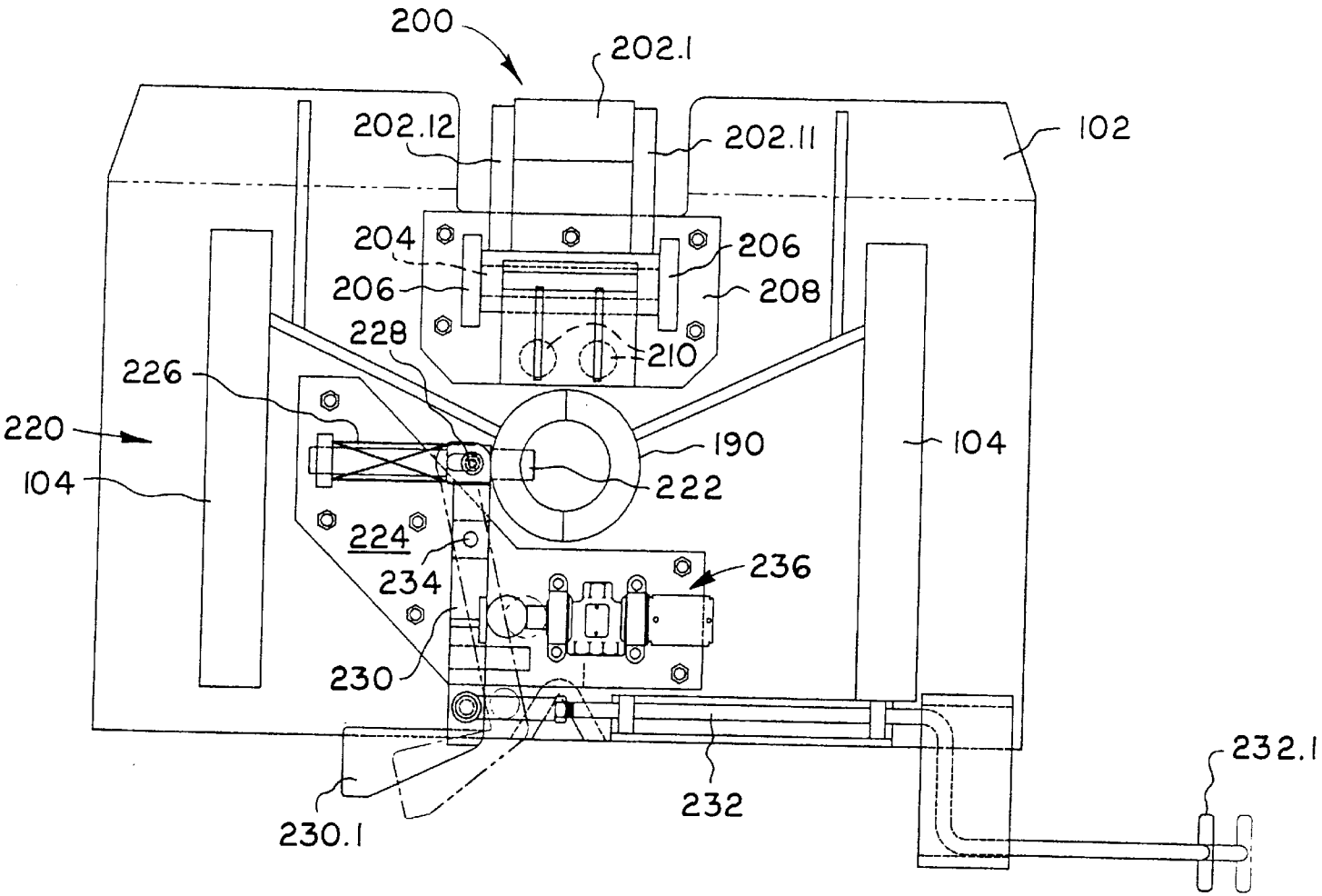
FIG. 18 is a bottom view of the trailer support assembly of the intermodal rail vehicle, and also shows a coupler pin lock, a primary latch, a coupling pin cylinder enabling valve, and an activating rod.

It should be noted that the movement of the coupler pin 192 is controlled by an air cylinder assembly 194. In order to prevent the inadvertent descent of the coupler pin 192, a coupler lock assembly indicated generally at 220 in FIG. 18 is provided. The coupler lock assembly includes a lock pin 222 which is adapted to pass through an aperture 190.1 in the sleeve 190 (FIG. 16). The lock pin 222 is carried by a support plate 224 and is normally biased by a spring 226 to the centerline of the coupler pin. When the coupler pin 192 is raised by the air cylinder assembly 194, the lock pin 222 will snap in behind the raised pin 192 after it has attained its raised position.

Figure 19:
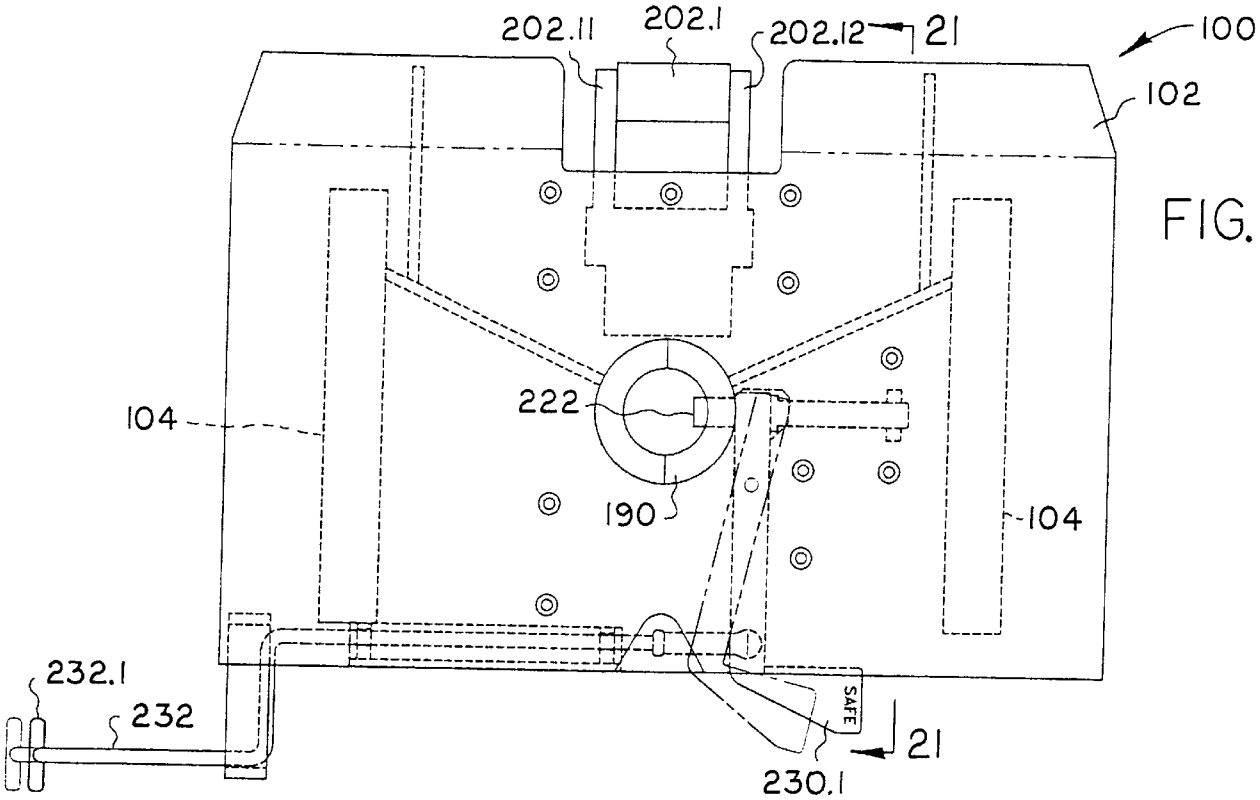
FIG. 19 is a top plan view of the structure shown in FIG. 18.
Figure 20:
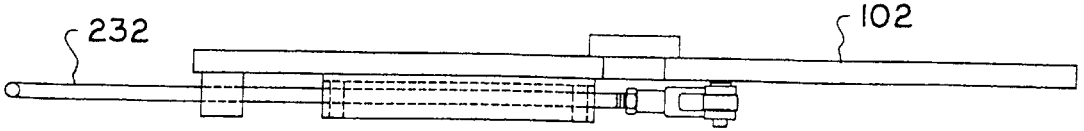
FIG. 20 is an end view of the design shown in FIG. 19.
Figure 21:
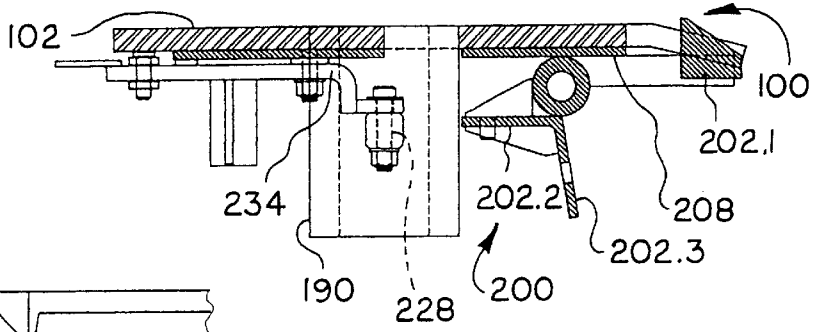
FIG. 21 is a section taken generally along the line 21—21 in FIG. 19.
Figure 22:
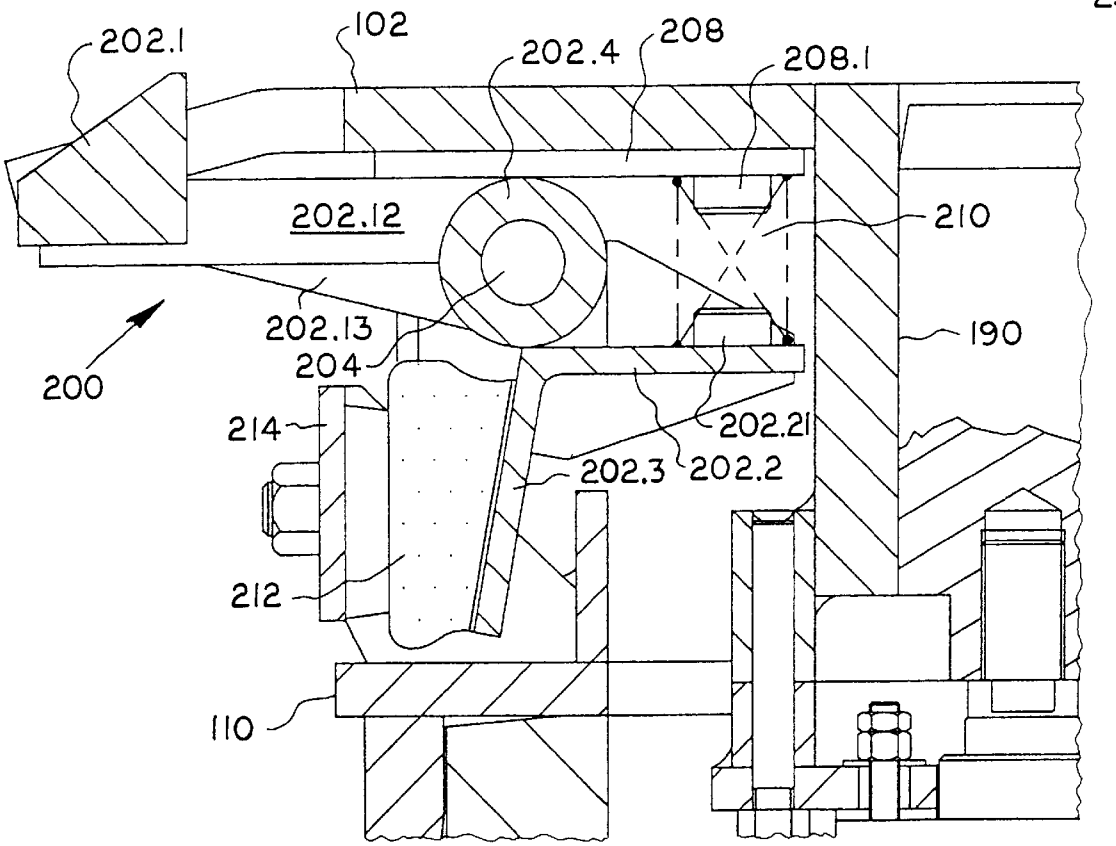
FIG. 22 is an enlarged detail sketch of a portion of the section shown in FIG. 21 showing the operation of the primary latch.

To lower the coupling pin 192 with the air cylinder assembly 194, it is essential that the lock pin 222 be retracted. This is done manually. To this end, a pin 228, which engages the lock 222, is moved away from the centerline of the coupling pin 192 by a lever 230, which lever is caused to be moved by an activating rod 232. Thus, with reference to FIG. 18, it can be seen that the coupler pin is normally spring biased to the position illustrated in full lines, but that when the handle 232.1 on rod 232 is pulled from the full line position to the dotted line position, the lever 230 will pivot about pin 234 moving the lock pin away from the centerline of the coupler pin 192 so that it can descend. When this happens, a flag 230.1 will be moved from its "safe" position (see FIG. 19) to another position where it will indicate that rail transport of the highway vehicle may be unsafe. At the same time the handle is moved from its full line position to its dotted line position, a coupler pin cylinder enabling valve, indicated generally at 236, will be engaged, which will permit the operation of the air cylinder assembly 194 to permit retraction of the coupler pin 192, and which will also introduce air into the air bag 212, to cause the primary latch 202.1 to moved to its released position shown in dotted lines in FIG. 22.

Finally, with reference to FIGS. 3 and 5, in order to provide for improved lateral stability of the highway trailers when mounted upon the intermodal rail vehicle of this invention, outboard supports 240 are provided. These supports are mounted upon the upper frame and may be manually adjusted for height via an internal gear box with a jack screw.

The operation of the intermodal rail vehicle of this invention should be apparent from the above to those having ordinary skill in the art. As the intermodal rail vehicles are bi-directional, and as the trailers designed for use with the rail vehicles of this invention are provided with virtually identical leading and trailing coupler socket assemblies, it is very easy to make up a train of highway trailers. In addition, such a train has improved stability over those previously known due to the unique design features of this intermodal rail vehicle. Finally, by the present design, the intermodal rail vehicles can be fabricated without undue expense.

It should be understood that applicant does not intend to be limited to the particular details described above and illustrated in the accompanying drawings. Thus, it is the desire of the inventor of the present invention that it be clearly understood that the embodiments of the invention, while preferred, can be readily changed and altered by one skilled in the art and that these embodiments are not to be limiting or constraining on the form or benefits of the invention.

What is claimed is:

1. An intermodal vehicle for forming a train of highway trailers including leading and trailing highway trailers which are interconnected to each other and supported by the intermodal vehicle for travel upon railroad tracks, each of the highway trailers including a leading coupler socket assembly at one end and a trailing coupler socket assembly at the other end, each intermodal vehicle having two rail wheel assemblies, lower frames supported on the two rail wheel assemblies, upper support frame means for supporting leading and trailing highway trailers, the upper support frame means being supported on the lower frames, the upper support frame means including leading and trailing load carrying structures; characterized by the provision of a continuous coupler tongue mounted on the upper support frame means and extending above the leading and trailing load carrying structures, each end of the continuous coupler tongue capable of being received within coupler socket assemblies of associated highway trailers supported on associated load carrying structures to connect the associated trailer to the intermodal vehicle.

2. The intermodal vehicle for forming a train of highway trailers as set forth in claim 1 wherein the leading and trailing load carrying structures are mounted on the upper support frame means for lateral movement, and further characterized by the provision of air operated actuator units for laterally moving the load carrying structures from side to side to assist in positioning the trailer on top of the load carrying structures.

3. The intermodal vehicle for forming a train of highway trailers as set forth in claim 1 wherein each of the coupler socket assemblies has vertically aligned spaced apart apertures, wherein each end of the continuous coupler tongue is provided with a vertically extending aperture, wherein leading and trailing vertically oriented coupler pins are carried by the upper support frame means, and wherein a coupler pin lifting mechanism is provided to effect a coupling between one end of the coupler tongue and a coupler tongue assembly of an associated trailer.

4. The intermodal vehicle for forming a train of highway trailers as set forth in claim 3 further characterized by the provision of a primary latch associated with each of the load carrying structures to initially hold the associated trailer in place while the coupler pin is being raised.

5. The intermodal vehicle for forming a train of highway trailers as set forth in claim 4 wherein the primary latch will "click" into place to supply an audible signal that the trailer is positioned properly.

6. The intermodal vehicle for forming a train of highway trailers as set forth in claim 3 further characterized by the provision of an extensible and retractable mechanism associated with each of the coupler pins to raise and lower the coupler pin, wherein a latch is provided for each coupler pin, wherein a mechanical latch operating assembly is provided for moving the latch either to a stop position under the coupler pin when it is in its raised position to prevent it from being accidentally lowered or away from the coupler pin to a non-stopping position to permit the coupler pin to be lowered from its raised position, and wherein an enabling mechanism is provided, the enabling mechanism being engaged by the mechanical latch operating assembly when the latch is in its non-stopping position to permit the extensible and retractable mechanism to lower the coupler pin.

7. The intermodal vehicle for forming a train of highway trailers as set forth in claim 6 wherein the extensible and retractable mechanism is an air cylinder assembly.

8. The intermodal vehicle for forming a train of highway trailers as set forth in claim 1 further characterized by the provision of a loading ramp associated with each of the load carrying structures to facilitate the loading of a trailer onto the load carrying structure as the intermodal vehicle and the trailer are moved towards each other.

9. The intermodal vehicle for forming a train of highway trailers as set forth in claim 1 further characterized by the provision of a pair of spaced apart outboard supports mounted to the sides of each of the leading and trailing load carrying structures, which supports are configured to allow adjustment so that the supports may contact the underside of a trailer mounted on the associated load carrying structure.

10. The intermodal vehicle for forming a train of highway trailers as set forth in claim 1 wherein the leading and trailing coupler sockets on each of the trailers are virtually identical, and wherein the each end of the coupler tongue is virtually identical, whereby each end of the continuous coupler tongue may be received in either the leading or trailing socket of each highway trailer.

11. An intermodal vehicle for forming a train of highway trailers supported by the intermodal vehicle for travel upon railroad tracks, each intermodal vehicle having two rail wheel assemblies, there being two wheels in each assembly, and a pair of lower frames supported on the two rail wheel assemblies;

characterized by the provision of upper support frame means for supporting leading and trailing highway trailers, the upper support frame means including leading and trailing load carrying structures, and further characterized by the provision of lifting means for raising and lowering the upper support frame means, the lifting means including spring assemblies in the form of air springs, there being one pair of spring assemblies for each wheel, one spring assembly being positioned before each wheel and one being positioned after each wheel, the air springs being so arranged that when air is removed from the air springs, the upper support frame means will descend toward the lower frame, and when air is introduced into the air springs, the upper support frame means will rise, at the same time raising any highway trailers which may be resting upon the load carrying surfaces.

12. The intermodal vehicle for forming a train of highway trailers as set forth in claim 11, wherein the leading and trailing load carrying structures are mounted on the upper support frame means for lateral movement, further characterized by the provision of air operated actuator units for laterally moving the load carrying structures from side to side, and further characterized by the provision of a gravity-operated center lock for locking the load carrying structures in their centered position when the upper support frame means is in its raised position.

13. The intermodal vehicle for forming a train of highway trailers as set forth in claim 11 further characterized by the provision of a loading ramp associated with each of the load carrying structures to facilitate the loading of a trailer onto the load carrying structure as the intermodal vehicle and the trailer are moved towards each other.

14. The intermodal vehicle for forming a train of highway trailers as set forth in claim 11 further characterized by the provision of a pair of spaced apart outboard supports mounted to the sides of each of the leading and trailing load carrying structures, which supports are configured to allow adjustment so that the supports may contact the underside of a trailer mounted on the associated load carrying structure.

15. The intermodal vehicle for forming a train of highway trailers as set forth in claim 11 wherein a plurality of guide struts are provided external to the air spring assemblies to guide the movement of the upper frame means relative to the lower frames.

16. The intermodal vehicle for forming a train of highway trailers as set forth in claim 15 wherein steering dampers are provided adjacent one end of the struts to act to restrain horizontal movement of the upper frame means relative to the lower frames.

* * * * *